US008103183B2

(12) United States Patent
Nemoto et al.

(10) Patent No.: US 8,103,183 B2
(45) Date of Patent: Jan. 24, 2012

(54) HEATER CONTROL WITH VARYING CONTROL CYCLE AND LIGHTING PATTERN

(75) Inventors: Eiji Nemoto, Tokyo (JP); Norikazu Okada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 147 days.

(21) Appl. No.: 12/725,630

(22) Filed: Mar. 17, 2010

(65) Prior Publication Data

US 2010/0239301 A1 Sep. 23, 2010

(30) Foreign Application Priority Data

Mar. 18, 2009 (JP) ..... 2009-066996
Mar. 16, 2010 (JP) ..... 2010-058814

(51) Int. Cl.
*G03G 15/20* (2006.01)

(52) U.S. Cl. ..... 399/69; 399/67

(58) Field of Classification Search ..... 219/216; 399/67, 69, 70, 88
See application file for complete search history.

(56) References Cited

U.S. PATENT DOCUMENTS

| | | | | |
|---|---|---|---|---|
| 5,367,369 | A | 11/1994 | Nakai et al. | |
| 6,301,454 | B1 | 10/2001 | Nishida et al. | |
| 6,901,226 | B2 * | 5/2005 | Claassen | 399/67 |
| 7,088,937 | B2 * | 8/2006 | Kataoka | 399/69 |
| 7,511,727 | B2 * | 3/2009 | Nishida | 347/156 |
| 7,721,121 | B2 * | 5/2010 | Kim et al. | 713/300 |

FOREIGN PATENT DOCUMENTS

| | | |
|---|---|---|
| JP | 11-095611 | 4/1999 |
| JP | 3055304 | 6/2000 |
| JP | 2004-212510 | 7/2004 |
| JP | 2005-107051 | 4/2005 |
| JP | 2007-034011 | 2/2007 |

* cited by examiner

*Primary Examiner* — Hoang Ngo
(74) *Attorney, Agent, or Firm* — IPUSA, PLLC

(57) ABSTRACT

A heater controlling apparatus for controlling supply of alternating current power to at least one heater that heats a heating object includes a detection unit configured to detect a temperature of the heating object, a determining unit configured to determine a proportion of lighting time for lighting the heater based on the detected temperature and a preset target temperature of the heating object, and a control unit configured to control the supply of alternating current power to the heater based on both a control cycle and one or more lighting patterns, the heater being lit according to the one or more lighting patterns defined for each control cycle, and both the control cycle and the lighting pattern varying in response to the determined proportion of lighting time.

15 Claims, 15 Drawing Sheets

HEATER CONTROL WITH VARYING CONTROL CYCLE AND LIGHTING PATTERN

BACKGROUND OF THE INVENTION

1. Field of the Invention

The disclosures herein generally relate to a heater control apparatus, an image forming apparatus, a heater control method, and a program for controlling the lighting of a heater.

2. Description of the Related Art

In an image forming apparatus that uses a fuser unit to heat and fuse a toner image transferred onto a record member such as a paper sheet, the temperature of the fuser unit is properly controlled in consideration of user convenience and energy efficiency. The fuser unit includes a heating roller having an embedded heater such as a halogen heater and a temperature sensor to detect the surface temperature of the heating roller. A heater control apparatus controls the power activation of the heater based on the surface temperature in light of a target temperature to achieve a preset temperature. As a control method, a wave-number-based control scheme is known to those skilled in the art. The wave-number-based control scheme controls the on/off state of a switching element for each half cycle of an alternating current by using a zero-cross signal of a commercial power supply as a reference (see Patent Document 1, for example). Patent Document discloses a heating apparatus that sub-samples waves at constant intervals for application of electric power in response to the surface temperature of the heating roller.

As a fuser unit, a heater of a large electric power exceeding 1000 Watts is generally used in order to shorten the time required to increase surface temperature to a preset temperature upon receiving a print request. Such a high power heater is known to create a rush current at the initial stage of temperature control. Halogen heaters, especially, tend to exhibit a large rush current at the initial stage of temperature control in a low-temperature state because halogen heaters exhibit a low resistance in a low-temperature state. A rush current reduces an alternating current voltage used as a power source, which causes a fluorescent light or the like using the same power source to create a flicker.

At the initial stage of temperature control, thus, a phase control (i.e., soft-start control) scheme may be employed in which a heater is powered on only with part of half a wave, followed by gradually increasing the power-on period (see Patent Document 2, for example). Patent Document 2 discloses an apparatus for controlling the heater of a fuser unit which performs phase control in the state in which a flicker is likely to occur, and performs wave-number-based control in the remaining states.

A frequency for which human vision is sensitive and thus perceives flickers is in the range centered at 8.8 Hz and extending to approximately 10 Hz. When a voltage fluctuation created by wave-number-based control includes a frequency component in the range of 8.8 to 10 Hz, human vision is likely to perceive a flicker.

The heater control apparatus disclosed in Patent Document 1 sub-samples one to three half waves at the initial stage of temperature control in which a rush current may occur. It has turned out that successive application of a control current having such a waveform creates a rush current at the cycle that is likely to cause a flickering sensation.

FIG. 15 illustrates an example of a lighting pattern for which a flicker is likely to be perceived. The illustrated lighting pattern includes frequency components in the range of 8.8 to 10 Hz, and is likely to cause a flicker to be perceived by human vision according to experiments. Accordingly, the occurrence of flickers may be reduced, but it is difficult to suppress a flicker that is perceived by human vision, unless a deliberate measure is taken to remove frequency components that cause a flickering sensation.

In an attempt to prevent a flicker by use of wave-number-based control without using phase control, it is difficult to remove frequency components that cause flickers if the control cycle is fixed as in the case of the heater control apparatus disclosed in Patent Document 1.

Accordingly, it may be preferable to provide a heater control apparatus, an image forming apparatus, a heater control method, and a program that can suppress trouble caused by rush currents without using phase control.

SUMMARY OF THE INVENTION

It is a general object of at least one embodiment of the present invention to provide a heater control scheme that substantially eliminates one or more problems caused by the limitations and disadvantages of the related art.

In one embodiment, a heater controlling apparatus for controlling supply of alternating current power to at least one heater that heats a heating object includes a detection unit configured to detect temperature of the heating object, a determining unit configured to determine a proportion of lighting time for lighting the heater based on the detected temperature and a preset target temperature of the heating object, and a control unit configured to control the supply of alternating current power to the heater based on both a control cycle and one or more lighting patterns, the heater being lit according to the one or more lighting patterns defined for each control cycle, and both the control cycle and the lighting pattern varying in response to the determined proportion of lighting time.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

In the following, embodiments for carrying out the present invention will be described by referring to the accompanying drawings.

[Heater Control Apparatus]

A heater control apparatus 100 of this embodiment adjusts the switching timing of a heater (i.e., halogen heater) such that the switching frequency does not fall in the range of frequencies that cause a flicker to be perceived by human vision. To be specific, heater switching timing is controlled such that the on cycle (or off cycle) of the heater does not fall in a frequency band around 10 Hz, or its frequency components in the frequency band around 10 Hz are as small as possible. This is based on the understanding that frequencies in the range of 8.8 to 10 Hz are likely to produce a flickering sensation.

Figure 1:
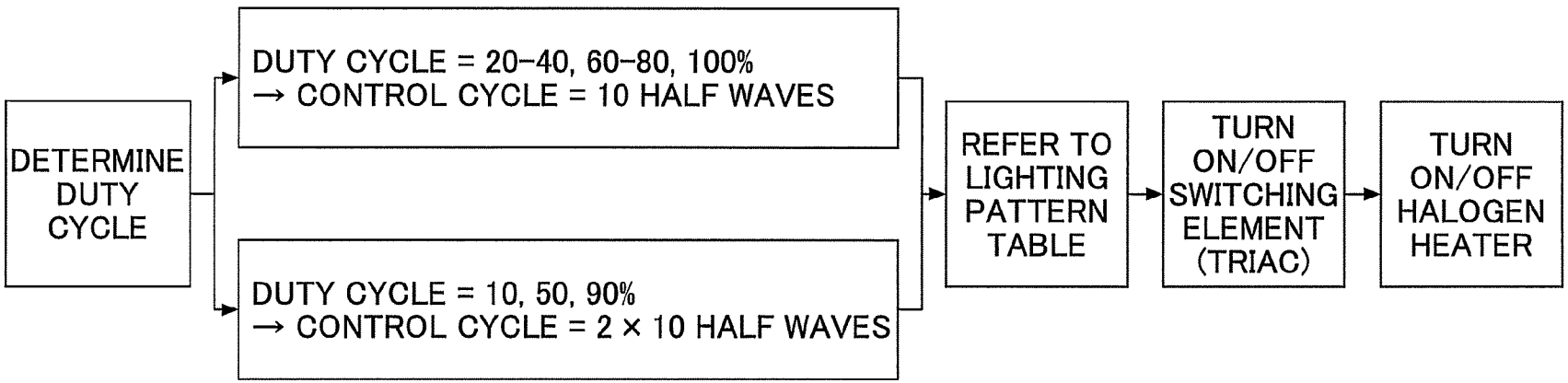
FIG. 1 is a drawing illustrating the operation scheme of a heater control apparatus.

FIG. 1 is a drawing illustrating the operation scheme of the heater control apparatus 100. As a general principle, the heater control apparatus 100 uses 10 half waves (with a 100-ms cycle) as a control cycle, which is close to a frequency that produces a flicker, and selectively activates the heater on a half-cycle basis to suppress flickers as much as possible. Since no phase control is used, there is no need to take measures against harmonic electric currents and terminal voltage noises.

The reason why 10 half waves have a 100-ms cycle is that a 50-Hz commercial power supply (i.e., alternating current power supply) has a wavelength of 20 ms, a half of which is equal to 10 ms, with 10 half waves amounting to 100 ms. Activation of the heater once in 10 half waves corresponds to 10 Hz, which means that human vision is likely to perceive a flicker. In the case of a 60-Hz commercial power supply (i.e., alternating current power supply), 10 half waves amount to approximately 83 ms.

The heater control apparatus 100 of the present embodiment determines a duty cycle based on the surface temperature of a heating object and a target temperature, and further determines a control cycle based on the duty cycle. As previously noted, the control cycle is equal to 10 half waves as a general principle. When the duty cycle is 10%, 50%, or 90%, however, twice the 10 half waves are used as the control cycle. In this manner, the control cycle is changed for particular duty cycles, thereby selecting a power activation pattern that can suppress flickers as much as possible. Hereinafter, the power activation pattern will be referred to as a lighting pattern because power activation causes lighting of the heater.

Further, the heater control apparatus 100 has lighting patterns for 10% to 50% duty cycles stored in memory. Once a duty cycle and a control cycle are determined, the heater control apparatus 100 controls the on/off-state of the switching element in response to a lighting pattern corresponding to the determined duty cycle. These lighting patterns have been selected in advance such that almost no or minimum frequency components are present in the range of 8.8 to 10 Hz that is likely to produce a flickering sensation for all the duty cycles. As will be described later, the above-noted change in the control cycle ensures that the lighting patterns are selected to have almost no or minimum frequency components in the range of 8.8 to 10 Hz for duty cycles that are disadvantageous in terms of prevention of flickers.

As described above, the heater control apparatus 100 of the present embodiment can suppress flickers as much as possible for all the duty cycles without using phase control.

[Image Forming Apparatus]

Figure 2:
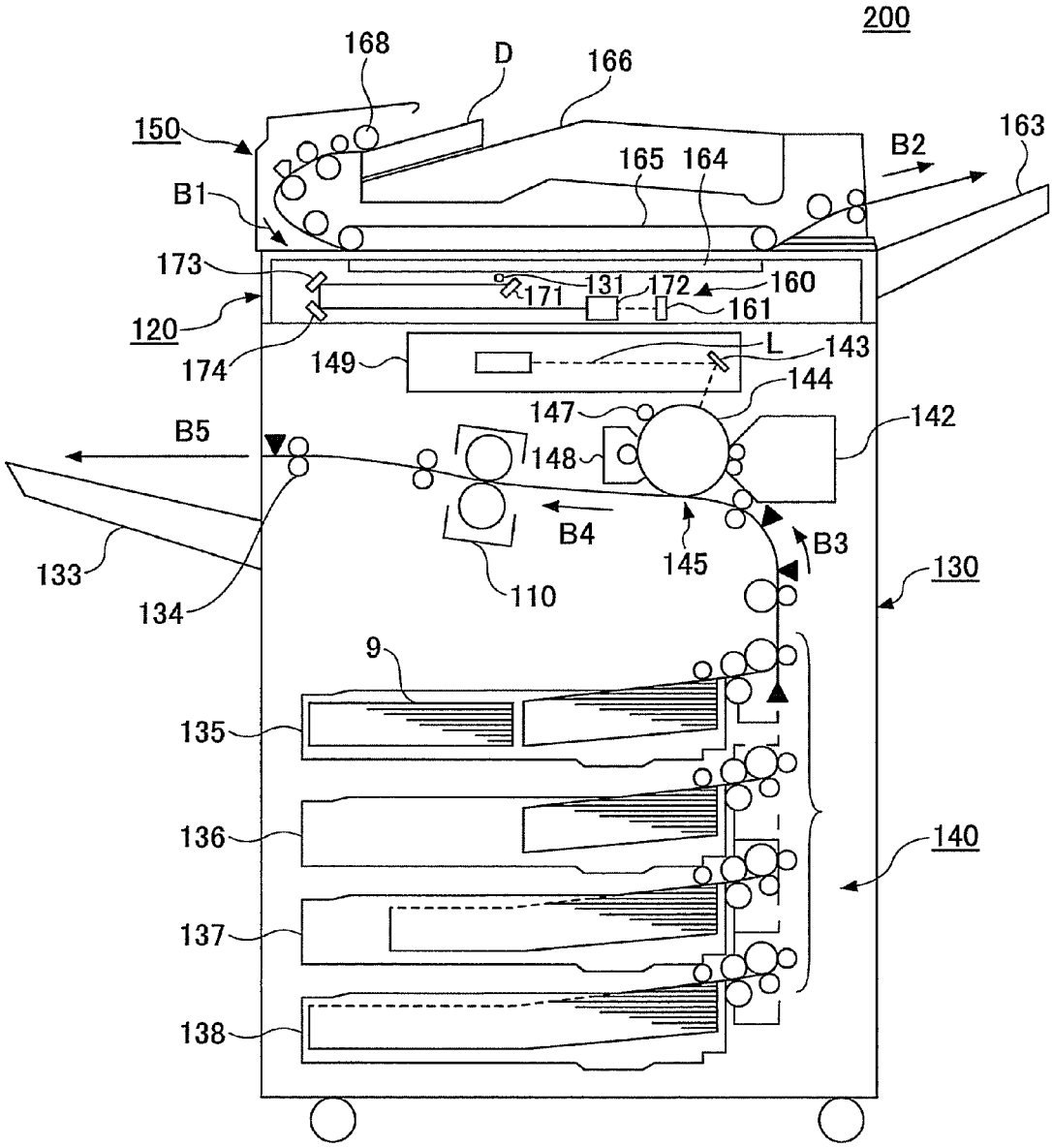
FIG. 2 is a drawing illustrating an example of the schematic configuration of an image forming apparatus.

FIG. 2 is a drawing illustrating an example of the schematic configuration of an image forming apparatus according to the present embodiment. An image forming apparatus 200 may be one that is known in the art. The image forming apparatus 200 illustrated in FIG. 2 includes a scan unit 120 for scanning a document, an image forming unit 130 for forming an image, an automatic document feeder 150 (hereinafter referred to as an ADF), a document receiving tray 163 for having documents stacked thereon as they are supplied from the ADF 150, a sheet feeder unit 140 including sheet feeding cassettes 135 through 138, a copy receiving tray 133 for having recording members 9 stacked thereon. Although a description in the following will be given of a copier machine serving as the image forming apparatus 200 of FIG. 2, a facsimile machine, a multifunction machine, or the like may also serve as the image forming apparatus 200.

An operation (such as pressing a print key) is performed on an input device (not shown) after setting a document D on a document platform 166 of the ADF 150. In response, the document sheet placed on the top is sent in a direction indicated by an arrow B1 due to the rotation of a pickup roller 168. Further, the document sheet is carried by the rotation of a document conveyor belt 165 to be placed on a contact glass 164 fixedly mounted on the scan unit 120. An image of the document sheet placed on the contact glass 164 is scanned by the scan unit 120, which is situated between the image forming unit 130 and the contact glass 164.

The scan unit 120 includes an exposure lamp 131 for illuminating a document sheet on the contact glass 164 and an optical system 160 for forming a document image. The optical system 160 includes a first mirror 171, a lens 172, and a CCD 161 on which a document image is formed. The exposure lamp 131 and the first mirror 171 are fixedly mounted on a first carriage (not shown), and a second mirror 173 and a third mirror 174 are fixedly mounted on a second carriage (not shown). When the first carriage moves in a sub-scan direction to scan a document sheet, the first carriage and the second carriage are moved by a mechanical means at speeds with a ratio of 2 to 1 so that the length of the optical path to the CCD does not change.

After the completion of image scanning, the document sheet is sent in a direction indicated by an arrow B2 by the rotation of the document conveyor belt 165 for ejection onto the document receiving tray 163. Document sheets of the document D are supplied one after another onto the contact glass 164, and document images are scanned by the scan unit 120.

An image processing unit (not shown) of the scan unit 120 uses the CCD to perform a photoelectric conversion with respect to the light emitted by the exposure lamp and reflected by the document sheet, thereby generating analog data. The analog data is converted by an A/D converter into digital image data, which is then subjected to shading correction, MTF correction, gamma correction, etc. The image data (digital data) having undergone these processes are stored in an HDD or the like.

A photoconductive body 144 serving as an image carrier is disposed inside the image forming unit 130. The photoconductive body 144 is driven to rotate clockwise in FIG. 2, with a charger device 147 charging its surface to a predetermined electric potential. A write unit 149 emits a laser light beam L optically modulated in response to image information scanned by the scan unit 120. A polygon mirror (not shown) rotating at high speed deflects the laser light beam. The deflected laser light beam L passes through an imaging lens (not shown) and is reflected by the mirror 143 to be shone on the photoconductive body 144.

The laser light beam L performs an exposure process for each line of the image information on the charged surface of the photoconductive body 144, thereby creating a latent electrostatic image on the surface of the photoconductive body 144. The latent electrostatic image is developed by attracting toner when passing through a development device 142. The developed image is transferred onto a recording member 9 that is supplied to a gap between the photoconductive body 144 and a transfer device 145. A cleaning device 148 cleans the surface of the photoconductive body 144 after the toner image is transferred.

The sheet feeding cassettes 135 through 138 situated at the bottom of the image forming unit 130 contain the recording members 9 such as paper sheets. A paper feed motor sends a recording member 9 in a direction indicated by an arrow B3 from one of the sheet feeding cassettes 135 through 138. A surface of the recording member 9 receives a toner image formed on the surface of the photoconductive body 144 as described above.

The sheet feeder unit 140 sends the recording member 9 through a fuser unit 110 of the image forming unit 130 as illustrated by an arrow B4, so that the toner image transferred onto the surface of the recording member 9 is fused by heat and pressure. Ejection rollers 134 carry the recording member 9 having passed through the fuser unit 110 for ejection onto the copy receiving tray 133 as illustrated by an arrow B5.

Although FIG. 2 illustrates an example of the image forming apparatus 200 that prints a monochrome image, the fuser unit 110 of the present embodiment is equally applicable to the image forming apparatus 200 that prints a color image. In the case of color printing, toner images of four colors (cyan, magenta, yellow, and black), for example, are superimposed one over another to create a color image. To this end, four-color toner images are transferred one after another from photoconductive drums onto an intermediate transfer body (e.g., belt or drum) for superimposition, followed by transferring the superimposed toner image from the intermediate transfer body onto a recording member 9. A fusing process to fuse a transferred image with the recording member 9 is the same as the fusing process of the monochrome printing, except for the temperature and the like.

Although the image forming apparatus 200 illustrated in FIG. 2 is an example of a copier machine, the heater control apparatus 100 is equally applicable to a printer, a facsimile device, a scanner, and an MFP (i.e., multifunction peripheral) having one or more of these functions.

[Heater Control Apparatus]

Figure 3:
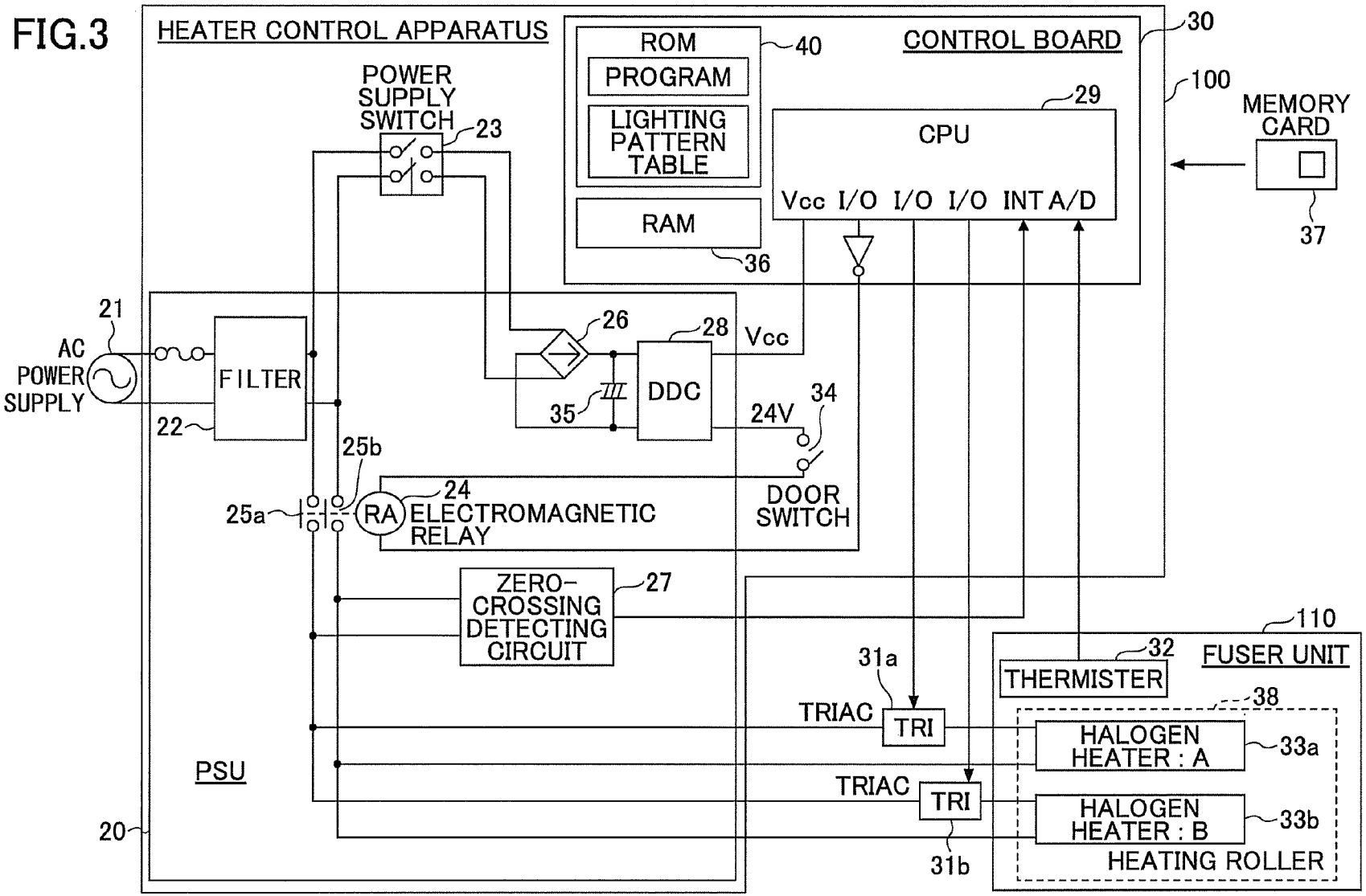
FIG. 3 is a drawing illustrating the configuration of the heater control apparatus of the image forming apparatus.

FIG. 3 is a drawing illustrating the configuration of the heater control apparatus 100 of the image forming apparatus 200. The image forming apparatus 200 illustrated in FIG. 3 includes the heater control apparatus 100 and the fuser unit 110. The heater control apparatus 100 includes a main power supply unit 20 and a control board 30. The heater control apparatus 100 includes a power supply switch 23 and a door switch 34. The control board 30 controls the on/off state of triacs 31*a* and 31*b* situated between the main power supply unit 20 and the fuser unit 110 to control the temperature of halogen heaters 33*a* and 33*b*. Two halogen heaters 33*a* and 33*b* are illustrated in FIG. 3. This is not a limiting example, and one halogen heater or three or more halogen heaters may be provided. Alternatively, another type of heater such as a ceramic heater may be used in place of the halogen heaters 33*a* and 33*b*.

The on state of the power supply switch 23 of the image forming apparatus 200 causes an electric current supplied by an AC power supply 21 to be supplied to a DDC (digital down converter) 28 after noise removal by a filter 22 and smoothing by a rectifying diode 26 and a smoothing condenser 35. The DDC 28 is a DC-DC converter of a switching type, and supplies a constant voltage Vcc to the control board 30 and a voltage of 24 V to an electromagnetic relay 24.

The electromagnetic relay 24 switches on switches 25*a* and 25*b* in response to the on state of the door switch 34 of the image forming apparatus 200. The electromagnetic relay 24 serves as a safety device for the fuser unit 110 by controlling the off state of the control board 30.

A zero-crossing detecting circuit 27 detects zero-crossing points of an alternating current supplied from the AC power supply 21. The control board 30 connected to the zero-crossing detecting circuit 27 controls the on/off state of the triacs 31*a* and 31*b* in response to the detected zero-crossing points. When the switches 25*a* and 25*b* are placed in a conductive state by the electromagnetic relay 24, the alternating current supplied to the zero-crossing detecting circuit 27 has a voltage coming close to zero at half-cycle intervals. Because of this, a transistor (not shown) inside the zero-crossing detecting circuit 27 cannot maintain an on-state voltage. The zero-crossing detecting circuit 27 detects this transistor condition to supply a zero-crossing signal to the control board 30.

In the following, the control board 30 will be described. The control board 30 is implemented as a computer, and includes a CPU 29 serving as a control unit, a RAM 36, a ROM 40, and an NVRAM (not shown) serving as memory units, an ASIC (application specific integrated circuit: not shown), and an input-and-output interface, which are connected through a bus. As previously described, the control board 30 controls the on/off state of the triacs 31*a* and 31*b* situated between the main power supply unit 20 and the fuser unit 110 to control the supply of electric currents to the halogen heaters 33*a* and 33*b*.

A thermistor 32 serving as a temperature detecting element is situated in close proximity of the halogen heater 33*a* of the fuser unit 110, and detects the surface temperature of a heating object that is heated by the halogen heaters 33*a* and 33*b* serving as heating units. The heating object is a heating roller 38. The CPU 29 performs an A/D conversion with respect to the temperature detected by the thermistor 32 to detect the surface temperature of the heating roller 38. As a temperature detecting element, a thermopile may be used in place of a thermistor.

The ROM 40 of the control board 30, for example, stores a program for performing heater control, a lighting pattern table, and so on. The lighting pattern table stores power activation duty cycles and lighting patterns associated with the respective power activation duty cycles. The power activation duty cycle indicates a ratio of power-active time to power-inactive time in a predetermined control period, which is used to control the supply of an alternating current power to the halogen heaters 33*a* and 33*b*. The above-noted program and lighting pattern table may be downloaded from an external server with which communication is held through an NIC (network interface card: not shown) or from a memory card 37 which is attached to a memory medium attaching unit (not shown).

The control board 30 retrieves a lighting pattern from the lighting pattern table stored in the ROM 40 in response to a duty cycle determined based on the surface temperature of the heating roller 38 and a target temperature. The control board 30 controls the on/off state of the triacs 31*a* and 31*b* in response to the retrieved lighting pattern. In the following, a description will be given of an example in which one halogen heater (hereinafter referred to as the halogen heater 33*a*) is provided.

[Lighting Pattern]

Figure 4:
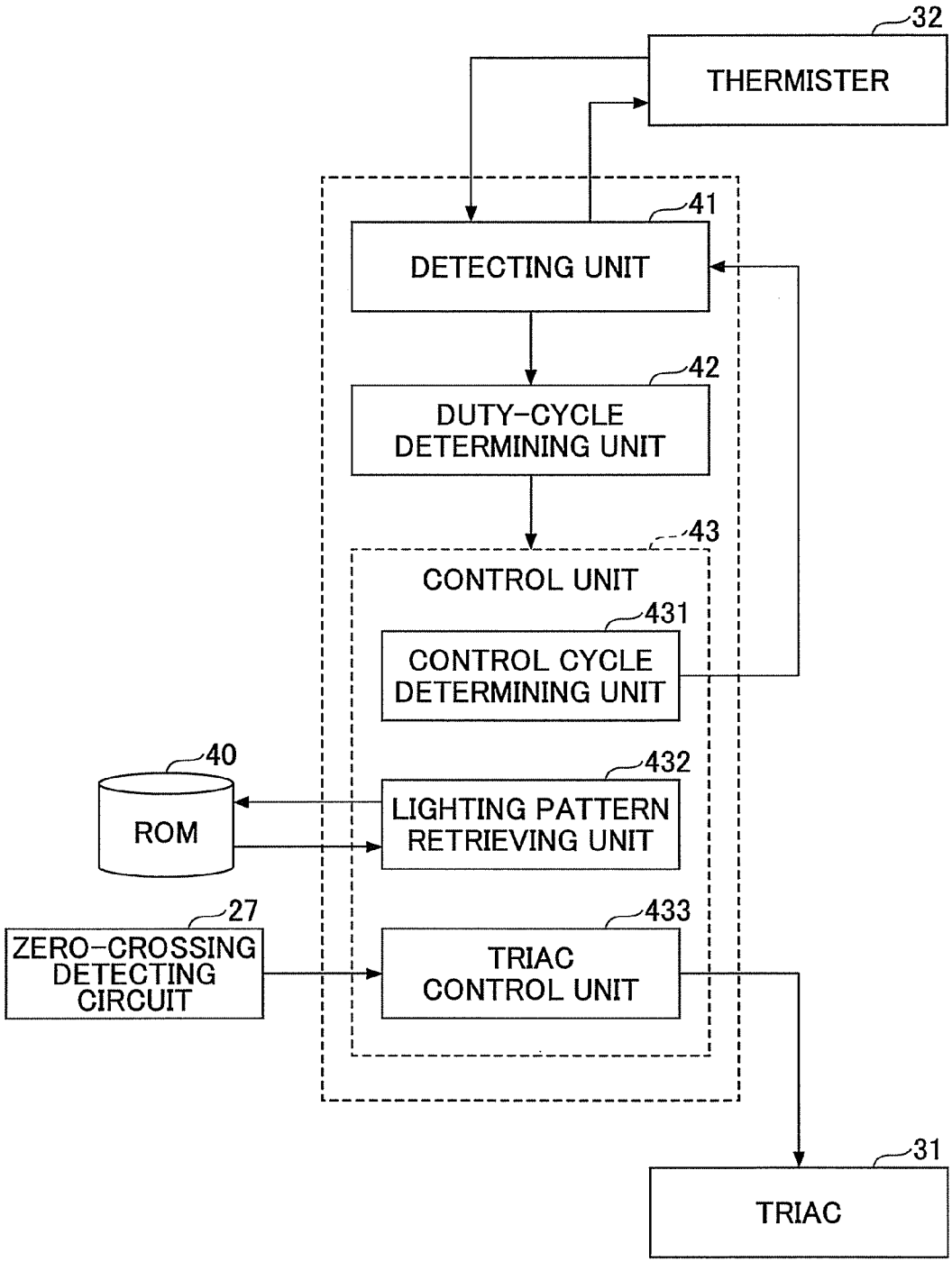
FIG. 4 is a functional block diagram illustrating an example of functions implemented by the heater control apparatus and a hardware configuration for achieving the functions.

FIG. 4 is a functional block diagram illustrating an example of functions implemented by the heater control apparatus 100 of the present embodiment and the hardware configuration for achieving the functions. The functions illustrated in FIG. 4 are provided by the control board 30 of the heater control apparatus 100, and, more specifically, are achieved by the CPU 29, the ASIC (not shown), and the RAM 36 or ROM 40 cooperating with each other.

A detecting unit 41 detects, based on the output value of the thermistor 32, the surface temperature of the heating roller 38 serving as a heating object. The detecting unit 41 detects the temperature of the halogen heater 33*a* serving as a fuser heater in response to a control cycle determined by a control cycle determining unit 431 of a control unit 43, which will be described later. A duty-cycle determining unit 42 determines a duty cycle indicative of a percentage of lighting time of the halogen heater 33*a* in response to a target temperature and the surface temperature of the heating roller 38 detected by the detecting unit 41. A calculated duty cycle may have a fractional part. Notwithstanding this, the heater control apparatus 100 of the present embodiment determines a duty cycle in units of 10%. A determined duty cycle may thus be one of 0%, 10%, 20%, 30%, 40%, 50%, 60%, 70%, 80%, 90%, and 100%.

The control unit 43 reads from the ROM 40 a lighting pattern assigned to the duty cycle determined by the duty-cycle determining unit 42. The control unit 43 turns on and off the triacs 31*a* and 31*b* in response to the retrieved lighting pattern to control the supply of alternating current to the halogen heater 33*a*.

Figure 5A:
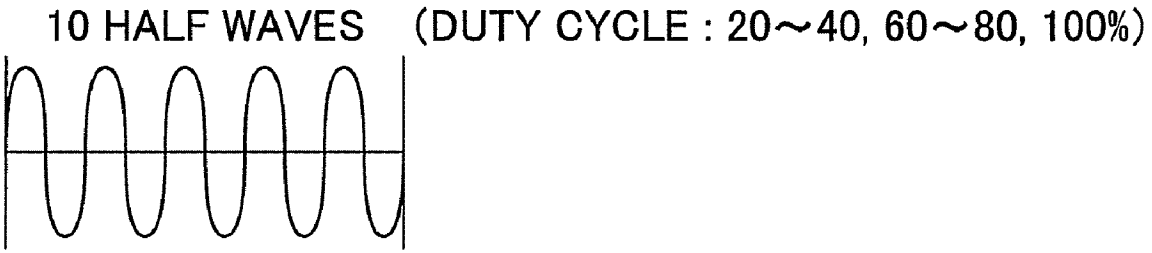
FIGS. 5A and 5B are drawings illustrating examples of control cycles responsive to duty cycles.
Figure 5B:
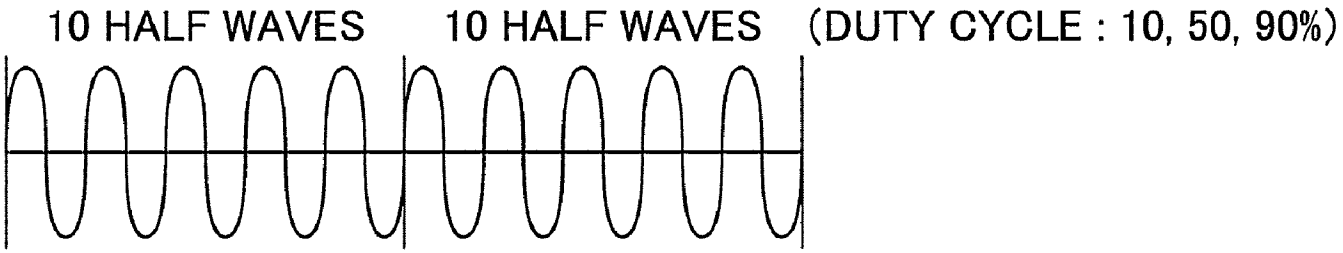

FIGS. 5A and 5B are drawings illustrating examples of control cycles responsive to duty cycles. FIG. 5A illustrates a control cycle that is used when the duty cycle is 20%, 30%, 40%, 60%, 70%, 80%, or 100%. FIG. 5B illustrates a control cycle that is used when the duty cycle is 10%, 50%, or 90%. The control cycle illustrated in FIG. 5A is equal to a combined length of 10 half waves, and the control cycle illustrated in FIG. 5B is equal to a combined length of 20 half waves. A length equal to 10 half waves of an AC power supply is a basic cycle. However, when the duty cycle is 10% or 90%, which tends to create a lighting pattern likely to produce a flickering sensation, the control cycle is extended to an integer multiple of the basic cycle (which is equal to a length of 10 half waves in the present embodiment). Further, lighting control uses a single-sided lighting pattern when the duty cycle is 50%, as will be described later. In such a case, also, an integer multiple of the basic cycle is used as a control cycle, which is equal to a length of 20 half waves in the example illustrated in FIG. 5B.

[10% Duty Cycle]

Figure 6:
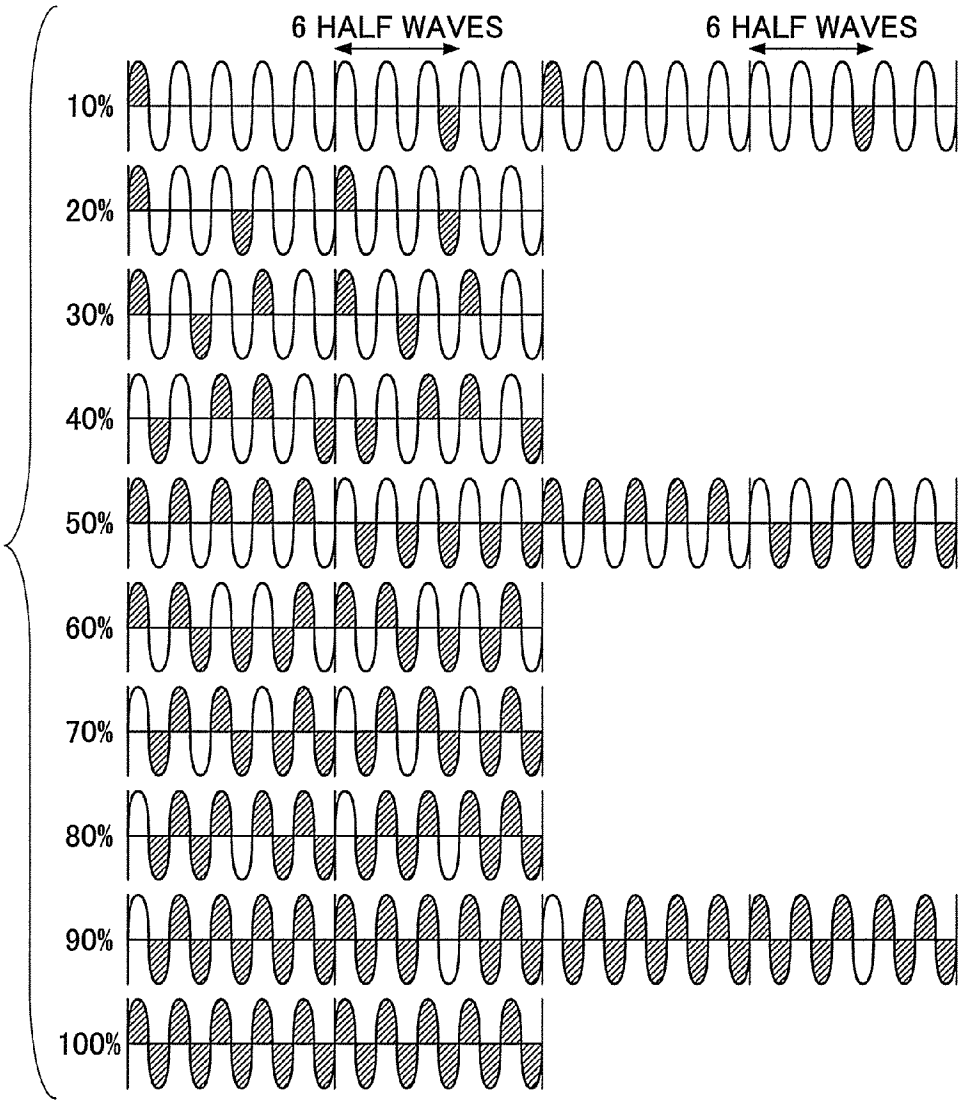
FIG. 6 is a drawing illustrating examples of lighting patterns for respective duty cycles.

FIG. 6 is a drawing illustrating examples of lighting patterns for respective duty cycles. A 10% duty cycle is achieved by turning on one half wave out of 10 half waves. In the case of the basic cycle equal to a length of 10 half waves, the control cycle becomes 100 ms when the alternating current voltage supplied by the AC power supply 21 is 50 Hz. A 10% duty cycle is achieved by providing the alternating current power from the AC power supply 21 to the halogen heater 33*a* only at a predetermined half wave out of 10 half waves by selectively turning on and off the triac 31. In such a case, the lighting pattern of the halogen heater 33*a* ends up having a frequency of 10 Hz, which is likely to produce a flickering sensation. The control cycle equal to a length of 10 half waves becomes 83 ms when the alternating current voltage supplied by the AC power supply 21 is 60 Hz. A lighting pattern corresponding to a 10% duty cycle thus has a frequency of 8.3 Hz, which bears a risk of producing a flickering sensation as in the case of the alternating current voltage being 50 Hz.

In consideration of the above, the control unit 43 supplies an alternating current power to the halogen heater 33*a* by use of a control cycle equal to an integer multiple of a length of 10 half waves serving as the basic cycle when the duty-cycle determining unit 42 illustrated in FIG. 4 determines that the duty cycle of the power supplied to the halogen heater 33 is 10%. Namely, the control unit 43 controls lighting such that the lighting pattern of the halogen heater does not have a frequency close to 10 Hz.

More specifically, the control unit 43 may control the supply of alternating current power at a cycle equal to an integer multiple of the basic cycle. Namely, a plurality of lighting patterns may be used to control the supply of alternating current power. The number of lighting occurrences is the same across the different lighting patterns, but the lighting timing varies. Such different lighting patterns are used to control the supply of alternating current power to the halogen heater 33*a*.

In the lighting pattern for a 10% duty cycle illustrated in FIG. 6, lighting timing is different between the first 10 half waves and the second 10 half waves wherein the basic cycle is equal to a length of 10 half waves in the present embodiment. The number of lighting occurrences is constant, and is one (i.e., one half wave) in each basic cycle. Namely, the first lighting pattern and the second lighting pattern each correspond to a lighting pattern for achieving a 10% duty cycle, but have lighting timings different from each other. Such different lighting timings are used to convert the frequency of the lighting of the halogen heater 33*a* into higher frequencies for which human vision is not likely to perceive a flicker. Namely, conversion to frequencies unlikely to produce flickering sensation is achieved while maintaining a 10% duty cycle.

In the example illustrated in FIG. 6, the lighting timing in the second 10 half waves is set such that the sixth half wave situated approximately at the midpoint of the 10-half-wave period is turned on. Analyzing the lighting patterns by use of FFT (Fast Fourier Transform) reveals that conversion into higher frequencies is achieved for the lighting of the halogen heater 33*a*, and that the frequency components in the range of 8.3 to 10 Hz are removed or minimized. In this manner, flickers are suppressed as much as possible even for a duty cycle that is disadvantageous in terms of prevention of flickers. It should be noted that the frequency components in the range of 8.3 to 10 Hz can also be made sufficiently small by alternately turning on one of the fourth to seventh half waves in the 10-half-wave period.

[20% to 40% Duty Cycles]

In the case of a duty cycle of 20% to 40%, the control cycle is set equal to the basic cycle that is a length of 10 half waves. In the case of a 20% duty cycle, two half waves out of 10 half waves are turned on. In the case of a 30% duty cycle, three half waves out of 10 half waves are turned on In the case of a 40% duty cycle, four half waves out of 10 half waves are turned on.

The lighting pattern in the control cycle is set to a high frequency pattern that avoids the frequency band around 10 Hz even though the control cycle is equal to a length of 10 half waves, which is more likely to produce a flickering sensation than is a control cycle equal to a length of three half waves, for example. In respect of any one of the above-noted duty cycles, FFT analysis performed on the voltage waveforms of the lighting patterns reveals that the frequency components in the range of 8.3 to 10 Hz are nonexistent or minimum. Flickers are reduced by turning on and off the halogen heater 33*a* at the timings controlled by these lighting patterns.

[50% Duty Cycle]

In the case of a 50% duty cycle, the ratio of on time to off time is 50 to 50 in 10 half waves. A lighting pattern having active half waves and inactive half waves alternating with each other is used so that the highest frequency components are obtained among all the duty cycles. This arrangement is advantageous in terms of prevention of flickers (i.e., unlikely to produce a flickering sensation). Since the halogen heater 33*a* is turned on at every other half wave, however, an alternating current waveform becomes a single-sided waveform. Namely, only positive half waves are used, or only negative half waves are used.

In consideration of the above, the control cycle in the present embodiment is set equal to a length of 20 half waves in the case of a 50% duty cycle, with the lighting timing being displaced by one half wave for each 10-half-wave period. As illustrated in FIG. 6, the halogen heater 33*a* is turned on at the positive half waves in the first 10 half waves, and are turned on at the negative half waves in the second 10 half waves. In this manner, the lighting pattern is designed to alternate polarity, thereby avoiding a single-sided lighting pattern. This can avoid single-sided lighting that creates a lopsided load condition while producing high frequency components. FFT analysis performed on the lighting pattern for a 50% duty cycle reveals that the frequency components in the range of 8.3 to 10 Hz are very small from the beginning.

[60% to 80% Duty Cycles]

A ratio of on time to off time is 50 to 50 in the case of a 50% duty cycle. Off time becomes predominant in the case of a duty cycle smaller than 50%, and on time becomes predominant in the case of a duty cycle larger than 50%. Since the sum of an off-time percentage and an on-time percentage is equal to 100%, a 20%-on condition means an 80%-off condition. Conversely, an 80%-on condition means a 20%-off condition.

A flicker occurs because human vision is sensitive to a certain voltage fluctuation. Accordingly, human vision also perceives a flicker even in the condition in which heater-on time is predominant with a shorter heater-off time in the control cycle. The level of perceived flickering is about the same between a lighting pattern having a duty cycle (smaller than 50%) in which the heater-on time is shorter than the heater-off time and a lighting pattern having a duty cycle (larger than 50%) in which the heater-on time is longer than the heater-off time.

In consideration of the above, a lighting pattern for a given duty cycle larger than 50% is obtained by inverting a lighting pattern of a corresponding duty cycle, which is obtained by subtracting the percentage of the given duty cycle from 100%. Here, the term "inverting" means replacing "on" with "off" and "off" with "on". With this arrangement, a lighting pattern for which frequency components in the range of 8.3 to 10 Hz are nonexistent or minimum is obtained. In the case of an 80% duty cycle, for example, a lighting pattern obtained by replacing "off" with "on" and "on" with "off" in the lighting pattern for a 20% duty cycle is used. This arrangement provides a lighting pattern for which frequency components in the range of 8.3 to 10 Hz are nonexistent or minimum.

Figure 7:
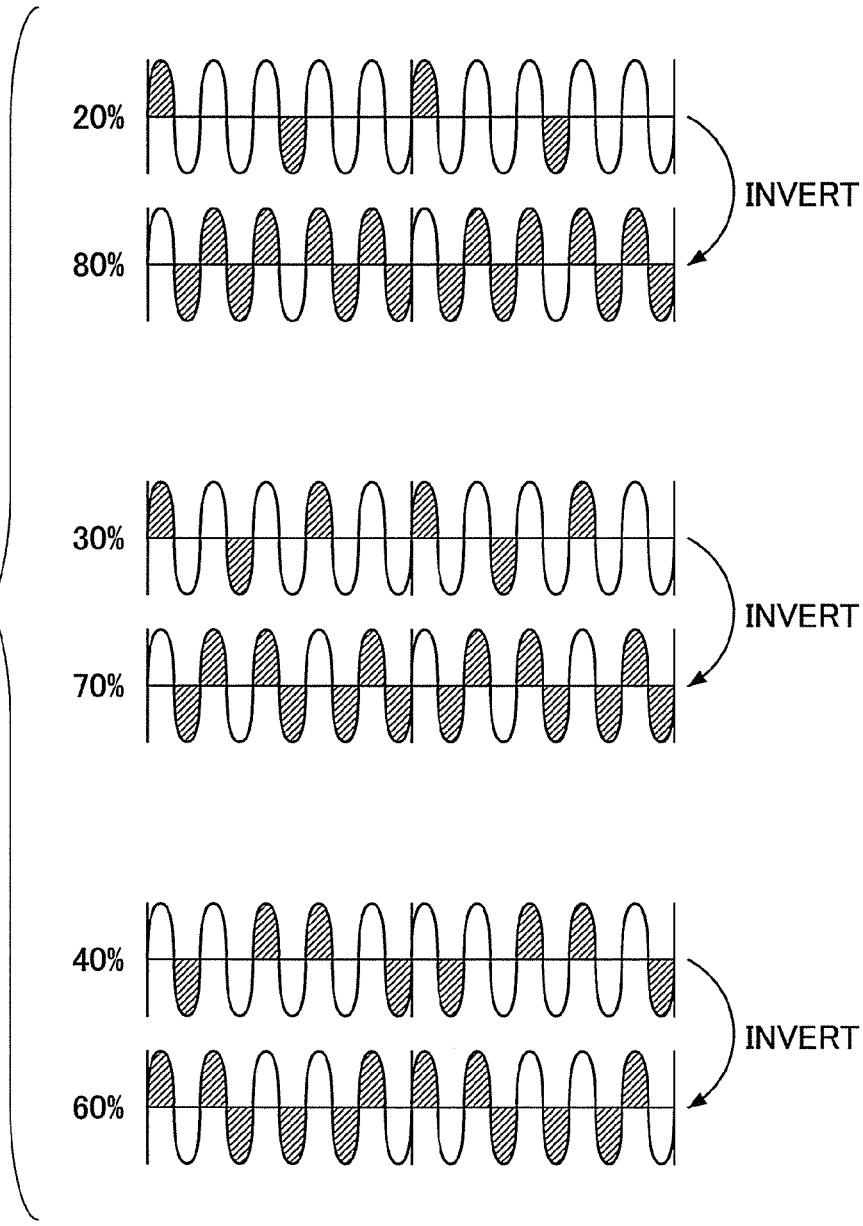
FIG. 7 is a drawing illustrating relationships between lighting patterns for 20% to 40% duty cycles and lighting patterns for 60% to 80% duty cycles.

FIG. 7 is a drawing illustrating relationships between lighting patterns for 20% to 40% duty cycles and lighting patterns for 60% to 80% duty cycles. As illustrated, a lighting pattern for an 80% duty cycle is obtained by inverting a lighting pattern for a 20% duty cycle. A lighting pattern for a 70% duty cycle is obtained by inverting a lighting pattern for a 30% duty cycle. A lighting pattern for a 60% duty cycle is obtained by inverting a lighting pattern for a 40% duty cycle.

The above-noted relationship concerning heater-on pulses and heater-off pulses also applies in the case of a 90% duty cycle. As can be seen from the lighting patterns for a 10% duty cycle and a 90% duty cycle illustrated in FIG. 6, the lighting pattern for a 90% duty cycle is obtained by replacing the "on" half waves with the "off" half waves and "off" half waves with the "on" half waves in the lighting pattern for a 10% duty cycle.

The use of lighting patterns as described above makes it possible to eliminate the need for lighting patterns dedicated for duty cycles larger than 50%, thereby consolidating control patterns for the halogen heater 33*a* and simplifying the control.

[90% Duty Cycle]

As described above, a flicker perceived with a 90% duty cycle is about the same as the flicker perceived with a 10% duty cycle. The control cycle is thus doubled as in the case of a 10% duty cycle. The lighting pattern used in this case is obtained by inverting the lighting pattern for a 10% duty cycle. Such lighting timings are used to convert the frequency of the lighting of the halogen heater 33*a* into higher frequencies. Namely, conversion to frequencies unlikely to produce a flickering sensation is achieved while maintaining a 90% duty cycle.

[0% Duty Cycle and 100% Duty Cycle]

The halogen heater 33*a* is not turned on in the control cycle in the case of a 0% duty cycle, and is turned on all the time during the control cycle in the case of a 100% duty cycle.

As described heretofore, the control unit 43 controls the supply of alternating current power to the halogen heater 33*a* based on a lighting pattern and control cycle responsive to a duty cycle determined by the duty-cycle determining unit 42. In the case of a determined duty cycle (i.e., a determined percentage of lighting time) of 10%, 50%, or 90%, the control unit 43 uses plural lighting patterns to control the supply of alternating current power to the halogen heater 33*a*. A lighting pattern table stored in the ROM 40 serving as a memory unit will now be described by referring to TABLE 1.

TABLE 1

| | n | | | | | | | | | |
|---|---|---|---|---|---|---|---|---|---|---|
| Duty | 1 | 2 | 3 | 4 | 5 | 6 | 7 | 8 | 9 | 10 |
| 10 1st | 1 | 0 | 0 | 0 | 0 | 0 | 0 | 0 | 0 | 0 |
| 10 2nd | 0 | 0 | 0 | 0 | 0 | 1 | 0 | 0 | 0 | 0 |
| 20 | 1 | 0 | 0 | 0 | 0 | 1 | 0 | 0 | 0 | 0 |
| 30 | 1 | 0 | 0 | 1 | 0 | 0 | 1 | 0 | 0 | 0 |
| 40 | 0 | 1 | 0 | 0 | 1 | 0 | 0 | 1 | 0 | 1 |
| 50 1st | 1 | 0 | 1 | 0 | 1 | 0 | 1 | 0 | 1 | 0 |
| 50 2nd | 0 | 1 | 0 | 1 | 0 | 1 | 0 | 1 | 0 | 1 |

This table shows an example of a lighting pattern table in which lighting patterns are assigned to 10% to 50% duty cycles. The rows correspond to duty cycles, and the columns correspond to wave numbers "n". The entry "1" indicates the power-on of the halogen heater 33*a*, and the entry "0" indicates the power-off of the halogen heater 33*a*. Lighting patterns may be assigned to 10% to 100% duty cycles, respectively. In the case of TABLE 1, lighting patterns are assigned to 10% to 50% duty cycles, respectively.

In the following, an entry of this table may be represented by use of notation P(C, p_num)[n]. The variable "C" represents a duty cycle, and the variable "p_num" assumes either one of "0" and "1" alternating with each other for each 10-half-wave period. The duty cycle C is set equal to 100-"duty cycle percentage" in the case of a duty cycle being larger than 50%. This arrangement serves to consolidate control patterns and to simplify the control.

In the case of the control cycle being equal to a length of 10 half waves, lighting control stays the same irrespective of whether the variable p_num is "0" or "1". In the case of the control cycle being equal to a length of 20 half waves, the lighting pattern defined for the first 10 half waves of the 20 half waves is used when the variable p_num is "0", and the lighting pattern defined for the second 10 half waves of the 20 half waves is used when the variable p_num is "1".

[Phase Control in Case of Duty Cycles Exceeding 50%]

When a time lapse from the last power-on of the halogen heater 33*a* to the next power-on of the halogen heater 33*a* is long, the temperature of the halogen heater 33*a* drops, resulting in a lower resistance. This creates a situation in which a large rush current is likely to flow at the next lighting. The lighting patterns previously described are designed to avoid the frequency components that are likely to produce a flicker. An increase in rush current, however, may increase the likelihood of producing a flickering sensation. Further, an increase in rush current may pose a danger of having an electric current exceeding the limits of circuit components. There may thus be a need to suppress a rush current.

Figure 8:
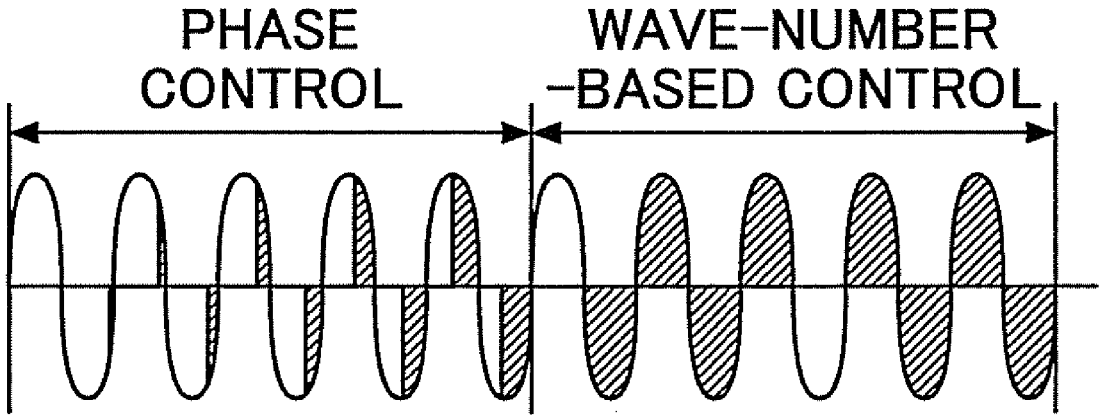
FIG. 8 illustrates an example of a lighting pattern for which phase control is performed.

In consideration of the above, the heater control apparatus 100 of the present embodiment not only performs wave-number-based control, but also performs phase control in which lighting timing (i.e., phase angle) within half a wave is gradually increased. FIG. 8 illustrates an example of a lighting pattern for which phase control is performed. What is illustrated in FIG. 8 corresponds to an 80% duty cycle. In each half wave that is turned on according to the lighting patterns previously described, a phase angle at which power is turned on is gradually increased with time, thereby achieving phase control. In FIG. 8, wave-number-based control starts immediately after the phase control that lasts for one control cycle. This is not a limiting example, and the phase control may be controlled such that wave-number-based control takes over only after phase control is performed over a plurality of control cycles.

The use of phase control achieves heater control that suppresses both flickers and rush current. Since the wave-number-based control using lighting patterns unlikely to produce a flicker is used, a duty cycle larger than it otherwise would be can be selected for use. This makes it possible to shorten an activation time compared to the activation time for which a normal phase control is used.

Rush current tends to be large when the temperature of the halogen heater 33*a* drops. A large duty cycle tends to be selected when the temperature of the halogen heater 33*a* is low. Accordingly, provision may be made such that phase control is employed only for a large duty cycle such as a duty cycle exceeding 50%.

[Procedure for Lighting Control]

Figure 9:
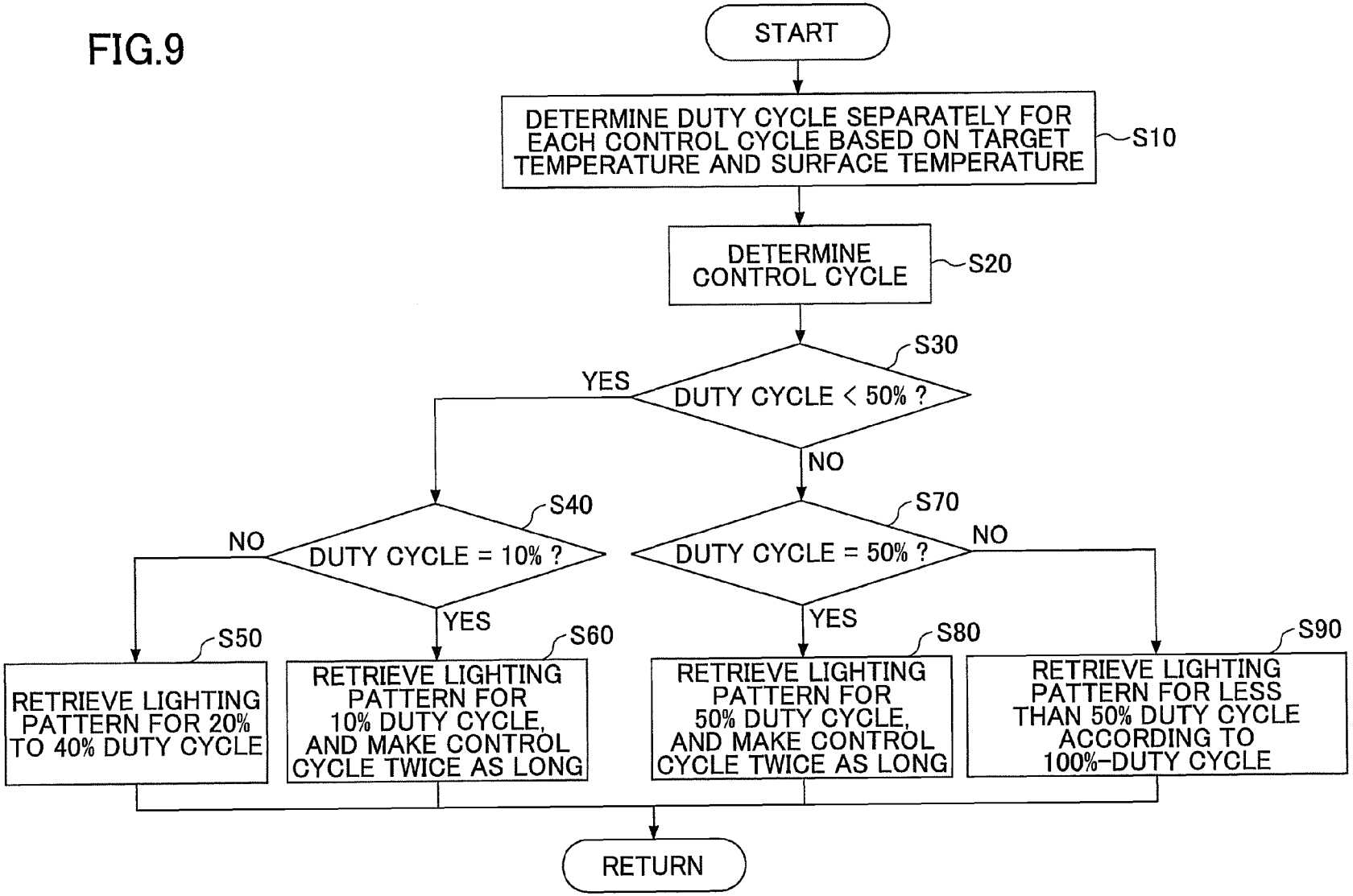
FIG. 9 is a flowchart illustrating an example of the procedure of determining a control cycle and a lighting pattern based on a duty cycle.

FIG. 9 is a flowchart illustrating an example of the procedure of determining a control cycle and a lighting pattern based on a duty cycle. By referring to FIG. 9, a description will be given of the procedure of determining a control cycle and a lighting pattern based on a duty cycle. A lighting pattern is determined separately for each control cycle (i.e., on a control-cycle-specific basis)

Upon completion of each control cycle, the duty-cycle determining unit 42 determines a duty cycle based on a target temperature and the surface temperature of the heating roller 38 detected by the thermistor 32 (S10). The target temperature may be set in the range of 180 to 200 degrees, for example.

The control cycle determining unit 431 of the control unit 43 determines a control cycle based on the duty cycle (S20). Namely, a period of 20 half waves is selected as the control cycle in the case of a duty cycle being 10%, 50%, or 90%. A period of 10 half waves is selected as the control cycle for other duty cycles.

A lighting pattern retrieving unit 432 checks whether the duty cycle is smaller than 50% (S30). In the case of the duty cycle being smaller than 50% (Yes in S30), the lighting pattern retrieving unit 432 further checks whether the duty cycle is 10% (S40). The fact that the duty cycle is not 10% (No in S40) indicates that the duty cycle is 20% to 40%. In such a case, the lighting pattern retrieving unit 432 retrieves a lighting pattern associated with one of the 20% to 40% duty cycles stored in the ROM 40 (S50).

In the case of the duty cycle being 10%, the lighting pattern retrieving unit 432 retrieves a lighting pattern associated with (i.e., assigned to) a 10% duty cycle (S60). In so doing, a plurality of lighting patterns associated with a 10% duty cycle are retrieved.

After the above-noted step S30, the lighting pattern retrieving unit 432 checks whether the duty cycle is 50% (S70). In the case of the duty cycle being 50% (Yes in S70), the lighting pattern retrieving unit 432 retrieves a lighting pattern associated with (i.e., assigned to) a 50% duty cycle (S80). In so doing, a plurality of lighting patterns associated with a 50% duty cycle are retrieved.

The fact that the duty cycle is not 50% (No in S70) indicates that the duty cycle is 60% to 90%. In such a case, the lighting pattern retrieving unit 432 retrieves a lighting pattern associated with one of the 10% to 40% duty cycles from the ROM 40 (S90). Namely, the lighting pattern retrieving unit 432 retrieves from the ROM 40 a lighting pattern associated with the duty cycle that is obtained by subtracting the duty cycle determined by the duty-cycle determining unit 42 from a duty cycle of 100%. In the case of the duty cycle determined by the duty-cycle determining unit 42 being 80%, for example, the lighting pattern retrieving unit 432 retrieves from the ROM 40 a lighting pattern associated with a duty cycle of 20% (=100%−80%). In the case of the duty cycle being 90%, the control cycle is twice as large since the lighting pattern for a duty cycle of 10% (=100%−90%) is retrieved.

As will be described later, the supply of alternating current power to the halogen heater 33*a* is controlled in a different manner when the duty cycle is larger than 50%. Namely, with the duty cycle being larger than 50%, a triac control unit 433 of the control unit 43 suspends the supply of alternating current power to the halogen heater 33*a* at the lighting timing indicated by the retrieved lighting pattern, and supplies an alternating current power to the halogen heater 33*a* at the non-lighting timing indicated by the retrieved lighting pattern.

[Lighting Control Based on Lighting Pattern]

Figure 10:
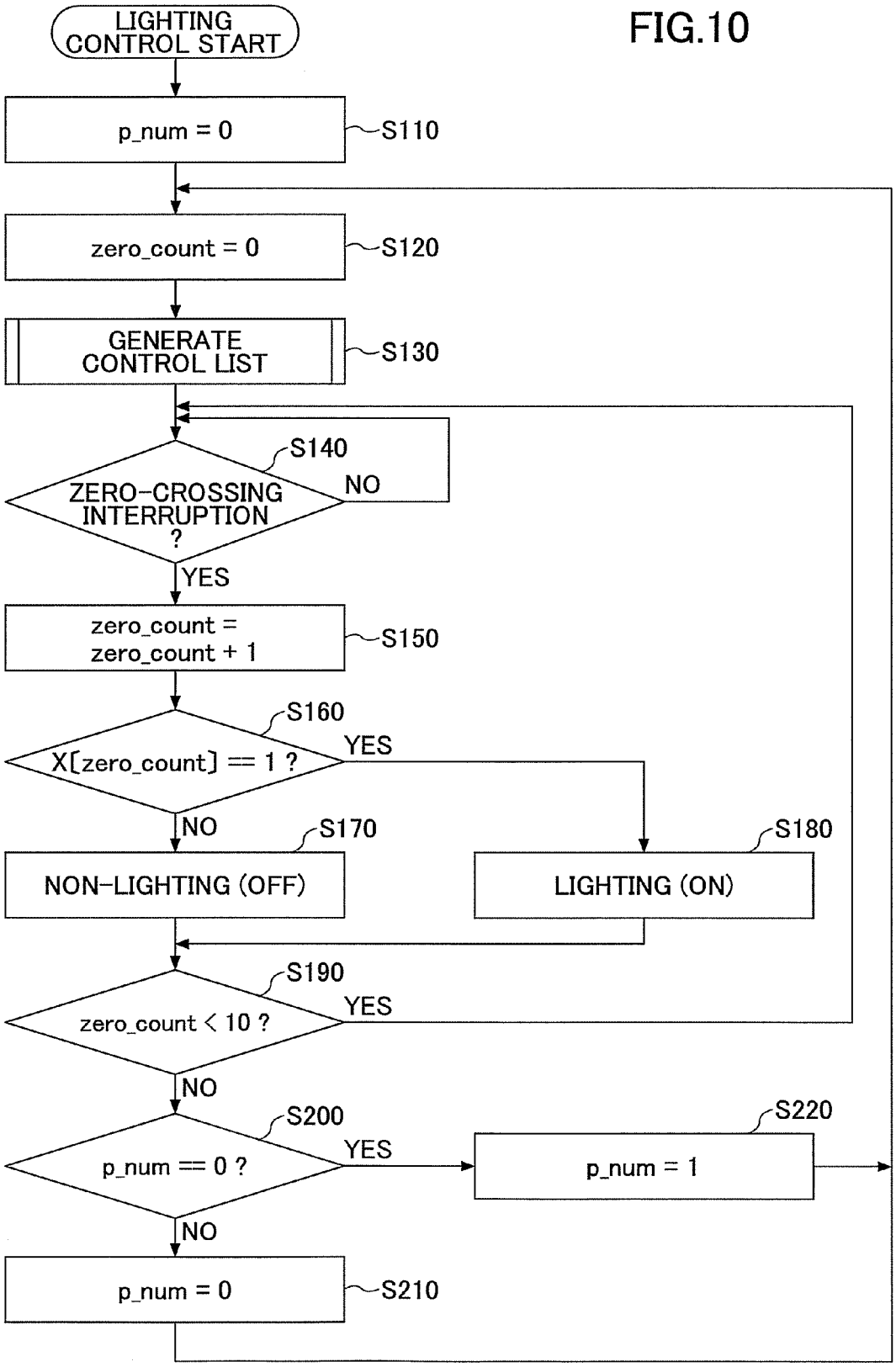
FIG. 10 is a flowchart illustrating an example of the procedure of controlling lighting based on a lighting pattern.

FIG. 10 is a flowchart illustrating an example of the procedure of controlling lighting based on a lighting pattern. The triac control unit 433 of the control unit 43 sets the variable p_num to "0" (S110). In the case of the control cycle being equal to a length of 20 half waves, the triac control unit 433 may switch lighting patterns depending on whether the variable p_num is "0" or "1".

The triac control unit 433 then sets a variable zero_count to "0" (S120). The variable zero_count indicates the number of zero-crossing interruptions occurring during each 10-half-wave period. Zero-crossing interruptions occur 10 times in 10 half waves, so that the variable zero_count assumes an integer value ranging from 0 to 10.

The triac control unit 433 generates a control list in which the on/off state of the halogen heater 33*a* is defined for each half wave of the 10-half-wave period (S130).

Figure 11:
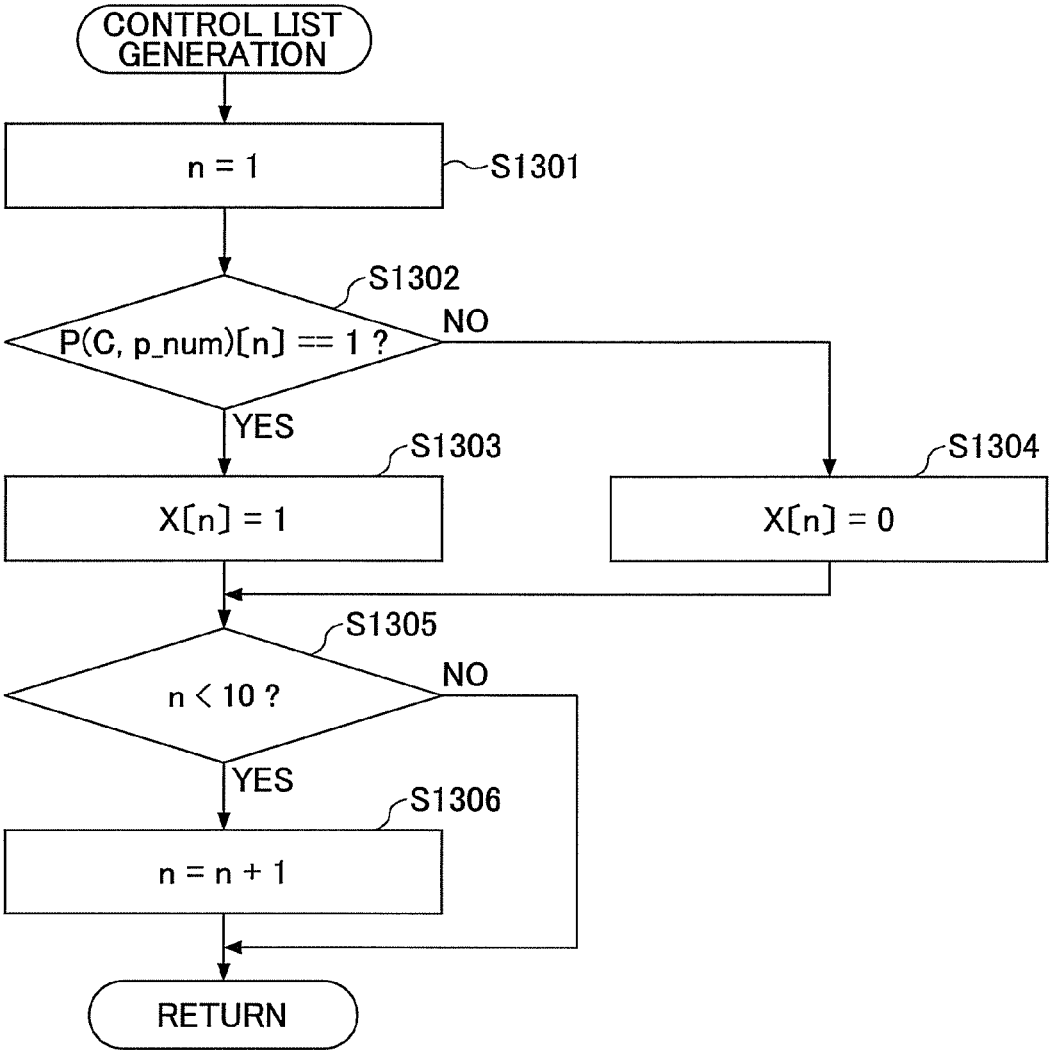
FIG. 11 is a flowchart illustrating an example of the procedure of generating a control list.

FIG. 11 is a flowchart illustrating an example of the procedure of generating a control list in step S130. The triac control unit 433 sets the initial value in a variable n (S1301). As previously described, the variable n indicates a wave number.

The triac control unit 433 checks whether P(C, p_num)[n] is "1" (S1302). Since the duty cycle C and the variable p_num are already determined, an entry of the previously-described lighting pattern table is referred to, thereby determining whether the entry is "1".

The entry "1" of the lighting pattern table indicates lighting, and the entry "0" indicates non-lighting. In the case of the entry being "1" (Yes in S1302), the triac control unit 433 sets "1" in X[n] (S1303). In the case of the entry being not "1" (No in S1302), the triac control unit 433 sets "0" in X[n] (S1304). X[n] represents the n-th element of the control list.

A check is then made as to whether settings to the control list are performed up to the tenth wave number (S1305). If the variable n is smaller than 10, n is incremented by 1 (i.e., n=n+1), followed by repeating the steps from step S1301. When settings to the control list are performed up to the tenth wave number, the procedure goes back to step S140 of FIG. 10.

Referring to FIG. 10 again, the triac control unit 433 checks whether the zero-crossing detecting circuit 27 detects zero-crossing to generate a zero-crossing interruption (S140). Upon occurrence of a zero-crossing interruption (Yes in S140), the variable zero_count is incremented by 1 (i.e., zero_count-zero_count+1 in S150). The triac control unit 433 then checks whether the element X[zero_count] of the control list is "1" (S160).

The triac control unit 433 activates the triac 31*a* in response to the element X[zero_count] being "1" (S180), and deactivates the triac 31*a* in response to the element X[zero_count] being "0" (S170).

A check is then made as to whether the on/off control is performed up to the tenth half wave (S190), which ensures that the on/off control is repeated until the tenth half wave (Yes in S190).

When the on/off control is performed up to the tenth half wave (No in S190), the triac control unit 433 checks whether p_num is "0" (S200). If p_num is not "0", p_num is set to "0" (S210). If p_num is "0", p_num is set to "1" (S220). This serves to switch the values of the variable p_num.

With p_num alternating between "1" and "0", a correct entry of the lighting pattern table is properly selected in step S1302 of FIG. 11 in the case of the duty cycle being 10%, 50%, or 90% (which corresponds to the case of the control cycle being a length of 20 half waves). Thereafter, the procedure illustrated in FIG. 10 is repeated until the duty cycle changes.

As described above, the heater control apparatus 100 controls the on/off state of the halogen heater 33*a* based on the lighting patterns, which have been selected in advance such that almost no or minimum frequency components are present in the range of 8.8 to 10 Hz that is likely to produce a flickering sensation for all the duty cycles. This serves to suppress a flickering sensation. Namely, there is no need to use phase control that would lead to a cost increase.

Moreover, phase control may be employed with the lighting patterns that are unlikely to produce a flickering sensation. Such an arrangement makes it possible to increase the temperature of the halogen heater 33*a* in a short time.

[Use of Two Halogen Heaters]

The above-described embodiment has been directed to an example in which one halogen heater is used. In the following, a description will be given of an example in which a plurality of halogen heaters is used.

In the following, an example in which the halogen heaters 33*a* and 33*b* are used will be described. The heater control apparatus 100 in the case of the halogen heaters 33*a* and 33*b* being used will be first described by referring to FIG. 4.

The duty-cycle determining unit 42 determines duty cycles for the halogen heaters 33*a* and 33*b*, respectively, in response to a target temperature and the surface temperature of the heating roller 38 detected by the thermistor. Here, the heating roller 38 serves as a heating object to be heated. The control cycle determining unit 431 determines control cycles for the halogen heaters 33*a* and 33*b*, respectively, based on the determined duty cycles. There may be a case in which one heater, either the halogen heater 33*a* or the halogen heater 33*b*, is assigned with a longer control cycle than is the other heater. In order to avoid the use of different control cycles for the halogen heaters 33*a* and 33*b* in the control procedure, provision may be made such that an alternating current power is supplied to such other heater multiple times by use of the same duty cycle.

Figure 12A:
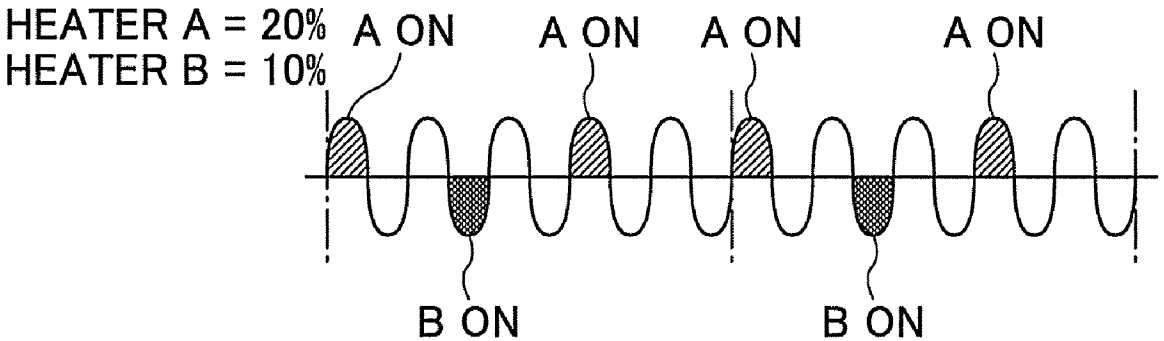
FIGS. 12A and 12B are drawings illustrating examples of lighting patterns used when plural halogen heaters are used.
Figure 12B:
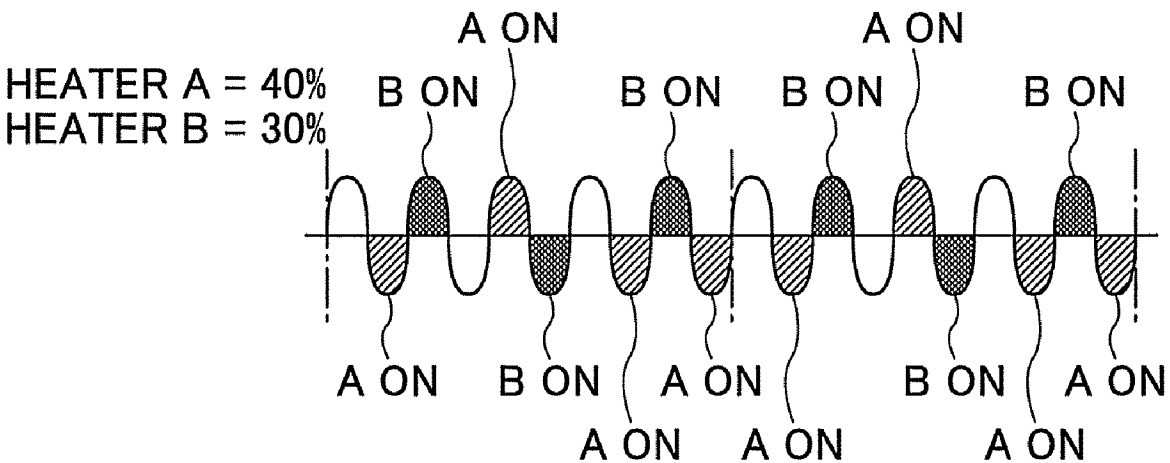

FIGS. 12A and 12B are drawings illustrating examples of lighting patterns used when plural halogen heaters are used. FIGS. 12A and 12B illustrate lighting patterns of respective halogen heaters when the sum of the duty cycles determined by the duty-cycle determining unit 42 does not exceed 100%. When the sum of the duty cycles does not exceed 100%, the control unit 43 retrieves a lighting pattern associated with the sum of the duty cycles from the ROM 40. Based on the retrieved lighting pattern, the control unit 43 lights the halogen heaters alternately, thereby controlling the supply of alternating current power based on the duty cycles determined for the halogen heaters 33*a* and 33*b*, respectively.

FIG. 12A illustrates lighting patterns of the two halogen heaters 33*a* and 33*b* in the case of the sum of duty cycles being smaller than 50%. In FIG. 12A, the duty cycle of the halogen heater 33*a* is 20%, and the duty cycle of the halogen heater 33*b* is 10%. The control unit 43 retrieves from the ROM 40 a lighting pattern assigned to a 30% duty cycle that is equal to the sum of the duty cycles.

The control unit 43 lights the halogen heaters 33*a* and 33*b* alternately based on the retrieved lighting pattern by starting with the heater assigned with the larger duty cycle. In FIG. 12A, the halogen heater 33*a* is assigned with a larger duty cycle than is the halogen heater 33*b*. The control unit 43 thus starts with the halogen heater 33*a*, and alternately lights the halogen heaters 33*a* and 33*b*. With this arrangement, the two halogen heaters 33*a* and 33*b* are lit with a lighting pattern that is advantageous in terms of prevention of flickers in the same manner as in the case of a duty cycle being 30% with the single halogen heater 33*a*.

FIG. 12B illustrates lighting patterns of the two halogen heaters 33*a* and 33*b* in the case of the sum of duty cycles being larger than 50%. In FIG. 12B, the duty cycle of the halogen heater 33*a* is 40%, and the duty cycle of the halogen heater 33*b* is 30%. The control unit 43 retrieves from the ROM 40 a lighting pattern assigned to a 30% duty cycle that corresponds to 100%-70% where 70% is the sum of the duty cycles. The control unit 43 uses as a lighting pattern for a 70% duty cycle a lighting pattern obtained by inverting the retrieved lighting pattern. Here, the term "inverting" means replacing "on" with "off" and "off" with "on".

By the same token, the control unit 43 lights the halogen heaters 33*a* and 33*b* alternately based on the inverted lighting pattern by starting with the heater assigned with the larger duty cycle. In FIG. 12B, the halogen heater 33*a* is assigned with a larger duty cycle than is the halogen heater 33*b*. The control unit 43 thus starts with the halogen heater 33*a*, and alternately lights the halogen heaters 33*a* and 33*b*.

With the above-described control, the lighting of the two halogen heaters 33*a* and 33*b* is evenly distributed while keeping a lighting pattern that is advantageous in terms of flicker prevention. Further, a ripple in the temperature created by the halogen heaters 33*a* and 33*b* can be suppressed.

Figure 13A:
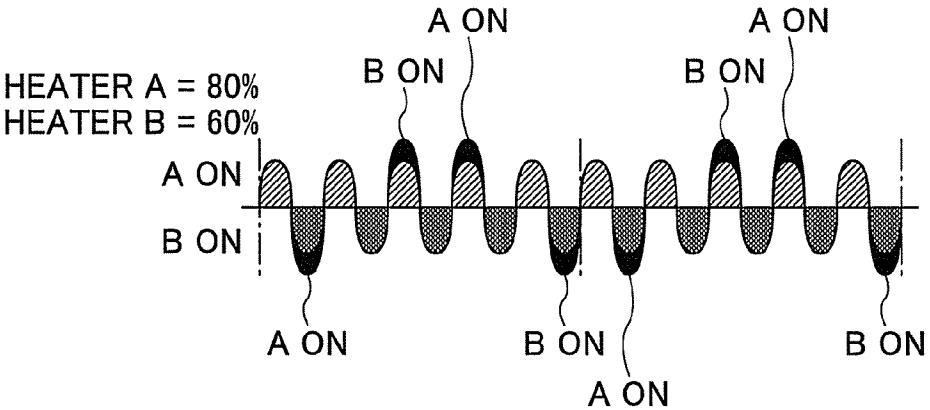
FIGS. 13A and 13B are drawings illustrating examples of lighting patterns used when plural halogen heaters are used.
Figure 13B:
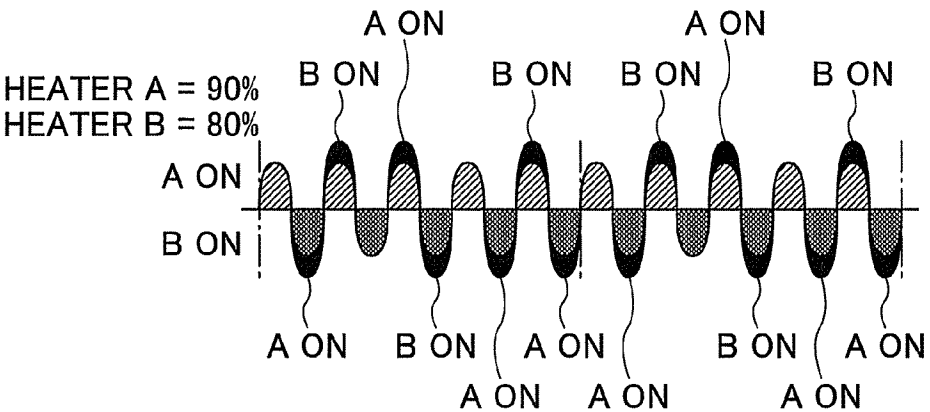

FIGS. 13A and 13B are drawings illustrating examples of lighting patterns used when plural halogen heaters are used. FIGS. 13A and 13B illustrate lighting patterns of respective halogen heaters 33*a* and 33*b* when the sum of the duty cycles determined by the duty-cycle determining unit 42 exceeds 100%. In the case of the sum of duty cycles exceeding 100%, the control unit 43 retrieves from the ROM 40 a lighting pattern assigned to the duty cycle corresponding to the last two digits of the sum.

FIG. 13A illustrates lighting patterns of the two halogen heaters 33*a* and 33*b* in the case of the sum of duty cycles being smaller than 150%. In FIG. 13A, the duty cycle of the halogen heater 33*a* is 80%, and the duty cycle of the halogen heater 33*b* is 60%. The sum is 140%, and the last two digits of the sum are 40%.

In the case of a 100% duty cycle, the halogen heaters 33*a* and 33*b* are lit alternately. Accordingly, a portion (i.e., 40%) in excess of 100% represents simultaneous lighting of the two halogen heaters 33*a* and 33*b*.

The control unit 43 retrieves from the ROM 40 a lighting pattern assigned to a 40% duty cycle corresponding to the last two digits of the sum of duty cycles. In FIG. 13A, half waves with black tips represent half waves at which simultaneous lighting is performed. The control unit 43 lights both of the halogen heaters 33*a* and 33*b* at the timing at which the "on" state is indicated by the 40% lighting pattern. In FIG. 13A, the halogen heater 33*a* is assigned with a larger duty cycle than is the halogen heater 33*b*. The control unit 43 thus starts with the halogen heater 33*a* for simultaneous lighting.

FIG. 13B illustrates lighting patterns of the two halogen heaters 33*a* and 33*b* in the case of the sum of duty cycles being larger than 150%. In FIG. 13B, the duty cycle of the halogen heater 33*a* is 90%, and the duty cycle of the halogen heater 33*b* is 80%. The sum is 170%, and the last two digits of the sum are 70%. In the case of a 100% duty cycle, the halogen heaters 33*a* and 33*b* are lit alternately. A portion (i.e., 70%) in excess of 100% represents simultaneous lighting of the two halogen heaters 33*a* and 33*b*.

The control unit 43 retrieves from the ROM 40 a lighting pattern assigned to a 30% duty cycle that corresponds to 100%-70% where 70% is the sum of the duty cycles. The control unit 43 then inverts the lighting pattern corresponding to the 30% duty cycle. The control unit 43 lights both of the halogen heaters 33*a* and 33*b* at the timing at which the "on" state is indicated by the inverted 70% lighting pattern. In FIG. 13B, the halogen heater 33*a* is assigned with a larger duty cycle than is the halogen heater 33*b*. The control unit 43 thus starts with the halogen heater 33*a* for simultaneous lighting.

All the halogen heaters 33*a* and 33*b* are provided with alternating current power at the lighting timing indicated by the retrieved lighting pattern, so that a ripple in the temperature generated by the halogen heaters 33*a* and 33*b* is suppressed.

[Lighting Control of Two Halogen Heaters]

Figure 14:
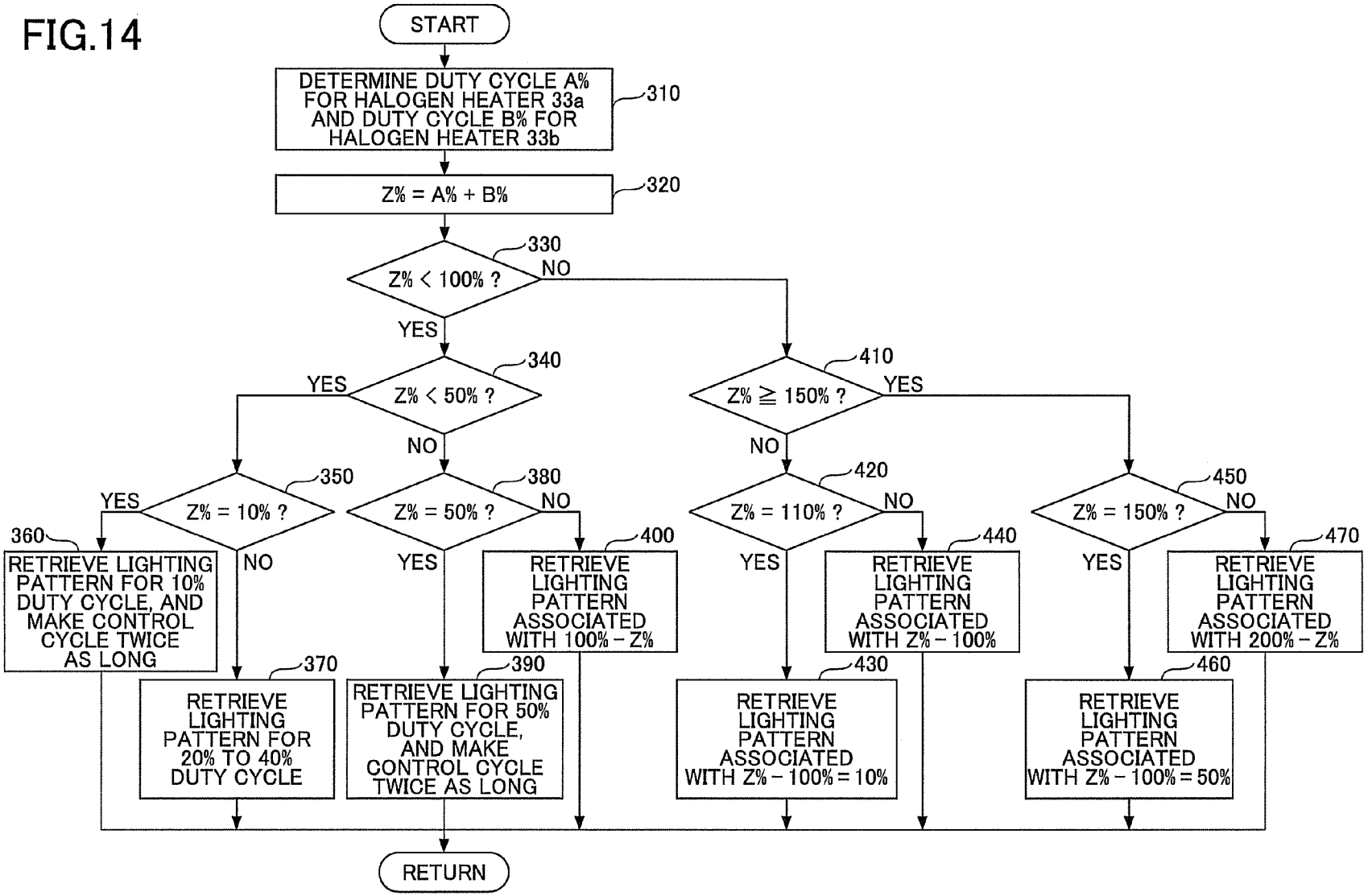
FIG. 14 is a flowchart illustrating an example of the procedure of controlling lighting performed by the control unit based on a lighting pattern in the case of two halogen heaters being used.
Figure 15:
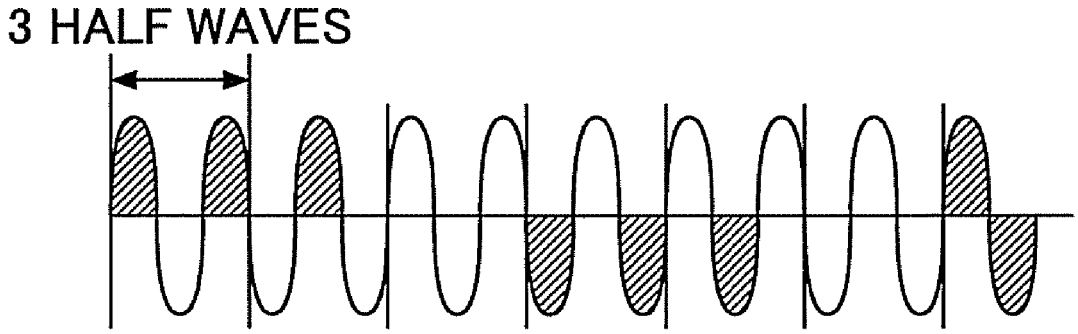
FIG. 15 is a drawing illustrating an example of a lighting pattern for which a flicker is likely to be perceived in a related-art heater controlling apparatus.

FIG. 14 is a flowchart illustrating an example of the procedure of controlling lighting performed by the control unit 43 based on a lighting pattern in the case of two halogen heaters being used.

Upon completion of each control cycle, the duty-cycle determining unit 42 determines respective duty cycles based on a target temperature and the surface temperature of the heating roller 38 detected by the thermistor 32 (S310). The duty cycle of the halogen heater 33*a* is A %, and the duty cycle of the halogen heater 33*b* is B %.

The lighting pattern retrieving unit 432 of the control unit 43 adds up A % and B % to obtain a total duty cycle Z % (S320).

The lighting pattern retrieving unit 432 checks whether the total duty cycle Z % is smaller than 100% (S330). If the total duty cycle Z % is smaller than 100%, the two halogen heaters 33*a* and 33*b* are not simultaneously lit.

In the case of the total duty cycle Z % being smaller than 100% (Yes in S330), the lighting pattern retrieving unit 432 checks whether the total duty cycle Z % is smaller than 50% (S340).

In the case of the total duty cycle Z % being smaller than 50% (Yes in S340), the lighting pattern retrieving unit 432 checks whether the total duty cycle Z % is 10% (S350).

In the case of the total duty cycle Z % being 10% (Yes in S350), the lighting pattern retrieving unit 432 retrieves a lighting pattern associated with (i.e., assigned to) a 10% duty cycle (S360). In so doing, a plurality of lighting patterns associated with a 10% duty cycle are retrieved. Namely, the control cycle is twice as long.

The fact that the total duty cycle Z % is not 10% (No in S350) indicates that the total duty cycle Z % is 20% to 40%. In such a case, the lighting pattern retrieving unit 432 retrieves a lighting pattern associated with one of the 20% to 40% duty cycles stored in the ROM 40 (S370).

In the case of the total duty cycle Z % being not smaller than 50% (No in S340), the lighting pattern retrieving unit 432 checks whether the total duty cycle Z % is 50% (S380).

In the case of the total duty cycle Z % being 50% (Yes in S380), the lighting pattern retrieving unit 432 retrieves a lighting pattern associated with (i.e., assigned to) a 50% duty cycle (S390). In so doing, a plurality of lighting patterns associated with a 50% duty cycle are retrieved. Namely, the control cycle is twice as long.

The fact that the total duty cycle Z % is not 50% (No in S380) indicates that the total duty cycle Z % is 60% to 90%. In such a case, the lighting pattern retrieving unit 432 calculates 100%-Z %, and retrieves a lighting pattern associated with the calculated duty cycle from the ROM 40 (S400). Namely, the lighting pattern retrieving unit 432 retrieves from the ROM 40 a lighting pattern associated with the duty cycle that is obtained by subtracting Z % from a duty cycle of 100%. In the case of the total duty cycle Z % being 90%, the control cycle is twice as large since the lighting pattern for a duty cycle of 10% (=100%-90%) is retrieved.

Returning to the step S330, in the case of the total duty cycle Z % being not smaller than 100% (No in S330), the lighting pattern retrieving unit 432 checks whether the total duty cycle Z % is larger than or equal to 150% (S410).

In the case of the total duty cycle Z % being not larger than or equal to 150% (No in S410), the lighting pattern retrieving unit 432 checks whether the total duty cycle Z % is 110% (S420).

In the case of the total duty cycle Z % being 110% (Yes in S420), the lighting pattern retrieving unit 432 retrieves a lighting pattern associated with (i.e., assigned to) "Z-100%" stored in the ROM 40 (S430). In the case of the total duty cycle Z % being 110%, Z-100% equals 10%, so that plural lighting patterns associated with a 10% duty cycle is retrieved. Namely, the control cycle is twice as long.

In the case of the total duty cycle Z % being not 110% (No in S420), the lighting pattern retrieving unit 432 retrieves a lighting pattern associated with "Z-100%" stored in the ROM 40 (S440). Namely, a lighting pattern associated with an indicated one of the 20% to 40% duty cycles is retrieved.

In the case of the total duty cycle Z % being larger than 150% (Yes in S410), the lighting pattern retrieving unit 432 checks whether the total duty cycle Z % is 150% (S450).

In the case of the total duty cycle Z % being 150% (Yes in S450), the lighting pattern retrieving unit 432 retrieves a lighting pattern associated with "150-100%=50%" stored in the ROM 40 (S460). In so doing, a plurality of lighting patterns associated with a 50% duty cycle is retrieved. Namely, the control cycle is twice as long.

In the case of the total duty cycle Z % being not 150% (No in S450), the lighting pattern retrieving unit 432 retrieves a lighting pattern associated with "200-Z %" stored in the ROM 40 (S470). In the case of the total duty cycle Z % being 190%, the control cycle is twice as large since the lighting pattern for a duty cycle of 10% (=200%−190%) is retrieved.

The triac control unit 433 identifies a halogen heater assigned with the larger duty cycle among the halogen heater 33*a* having the duty cycle A % and the halogen heater 33*b* having the duty cycle B %, and alternately turns on and off the halogen heaters 33*a* and 33*b* by starting with the identified halogen heater according to the lighting pattern selected in the steps S360 through S390. The triac control unit 433 alternately turns on and off the halogen heaters 33*a* and 33*b* by starting with the identified halogen heater according to a lighting pattern obtained by inverting the lighting pattern selected in the step S400 and retrieved from the ROM 40.

The triac control unit 433 identifies a halogen heater assigned with the larger duty cycle among the halogen heater 33*a* having the duty cycle A % and the halogen heater 33*b* having the duty cycle B %, and alternately turns on and off the halogen heaters 33*a* and 33*b* according to the lighting pattern selected in the steps S430 through S460 while the triac control unit 433 alternately turns on and off the halogen heaters 33*a* and 33*b* for simultaneous lighting by starting with the identified halogen heater. The triac control unit 433 alternately turns on and off the halogen heaters 33*a* and 33*b* for simultaneous lighting by starting with the identified halogen heater according to a lighting pattern obtained by inverting the lighting pattern selected in the step S470 and retrieved from the ROM 40.

Even in the case of two halogen heaters being used as described above, the control unit 43 lights the halogen heaters 33*a* and 33*b* such that almost no or minimum frequency components are present in the range of 8.8 to 10 Hz that is likely to produce a flickering sensation for all the duty cycles.

Further, the present invention is not limited to these embodiments, but various variations and modifications may be made without departing from the scope of the present invention.

The present application is based on Japanese priority applications No. 2009-066996 filed on Mar. 18, 2009, and No. 2010-058814 filed on Mar. 16, 2010, with the Japanese Patent Office, the entire contents of which are hereby incorporated by reference.

RELATED-ART DOCUMENTS

[Patent Document 1] Japanese Patent Application Publication No. 11-95611

[Patent Document 2] Japanese Patent Application Publication No. 2004-212510

What is claimed is:

1. A heater controlling apparatus for controlling supply of alternating current power to at least one heater that heats a heating object, comprising:

a detection unit configured to detect a temperature of the heating object;

a determining unit configured to determine a proportion of lighting time for lighting the heater based on the detected temperature and a preset target temperature of the heating object; and a control unit configured to control the supply of alternating current power to the heater based on both a control cycle and one or more lighting patterns, the heater being lit according to the one or more lighting patterns defined for each control cycle, and both the control cycle and the lighting pattern varying in response to the determined proportion of lighting time.

2. The heater controlling apparatus as claimed in claim 1, wherein the control unit is configured to control the supply of alternating current power to the heater by use of one lighting pattern or plural lighting patterns, whichever is selected according to the determined proportion of lighting time.

3. The heater controlling apparatus as claimed in claim 2, wherein each of the one or more lighting patterns is formed of a predetermined number of half waves, and the plural lighting patterns responsive to the determined proportion of lighting time used by the control unit to control the supply of alternating current power to the heater are such that a ratio of a number of lighting occurrences in one of the plural lighting patterns to the number of half waves constituting the one of the plural lighting patterns is in a range of 8.3 to 10.

4. The heater controlling apparatus as claimed in claim 2, wherein, when the plural lighting patterns responsive to the determined proportion of lighting time are used, the plural lighting patterns used by the control unit to control the supply of alternating current power to the heater are such that a number of lighting occurrences is the same across the plural lighting patterns, and such that lighting timing is different between the plural lighting patterns.

5. The heater controlling apparatus as claimed in claim 1, wherein the control unit is configured to perform phase control and wave-number-based control successively one after another, both the phase control and the wave-number-based control using the one or more lighting patterns responsive to the determined proportion of lighting time.

6. The heater controlling device as claimed in claim 1, further comprising a memory unit configured to store lighting patterns, associated with respective proportions of lighting time, separately for each proportion of at least 10%, 20%, 30%, 40%, and 50%, wherein in a case of the determined proportion of lighting time being larger than 50%, the control unit is configured to retrieve from the memory unit the one or more lighting patterns associated with a percentage obtained by subtracting the determined proportion of lighting time from 100%, and is further configured to stop the supply of alternating current power to the heater at lighting timing indicated by the retrieved one or more lighting patterns and to supply alternating current power to the heater at non-lighting timing indicated by the retrieved one or more lighting patterns.

7. The heater controlling apparatus as claimed in claim 6, wherein said at least one heater comprises a plurality of heaters, and the determining unit is configured to determine a proportion of lighting time for lighting a heater for each one of the heaters based on the detected temperature and the preset target temperature of the heating object, and wherein in a case of a sum of the determined proportions of lighting time for the heaters exceeding 100%, the control unit is configured to retrieve from the memory unit the one or more lighting patterns associated with last two digits of the sum, and to supply alternating current power to all the heaters at lighting timing indicated by the retrieved one or more lighting patterns.

8. An image forming apparatus, comprising the heater controlling apparatus of claim 1.

9. A computer-readable recording medium having a program embodied therein for causing a computer to control supply of alternating current power to at least one heater that heats a heating object, the program comprising program codes for causing the computer to perform:

a determining step of determining a proportion of lighting time for lighting the heater based on a temperature of the heating object detected by a detecting unit and a preset target temperature of the heating object; and a control step of controlling the supply of alternating current power to the heater based on both a control cycle and one or more lighting patterns, the heater being lit according to the one or more lighting patterns defined for each control cycle, and both the control cycle and the lighting pattern varying in response to the determined proportion of lighting time.

10. The computer-readable recording medium as claimed in claim 9, wherein the control step controls the supply of alternating current power to the heater by use of one lighting pattern or plural lighting patterns, whichever is selected according to the determined proportion of lighting time.

11. The computer-readable recording medium as claimed in claim 10, wherein each of the one or more lighting patterns is formed of a predetermined number of half waves, and the plural lighting patterns responsive to the determined proportion of lighting time used by the control step to control the supply of alternating current power to the heater are such that a ratio of a number of lighting occurrences in one of the plural lighting patterns to the number of half waves constituting the one of the plural lighting patterns is in a range of 8.3 to 10.

12. The computer-readable recording medium as claimed in claim 10, wherein, when the plural lighting patterns responsive to the determined proportion of lighting time are used, the plural lighting patterns used by the control step to control the supply of alternating current power to the heater are such that a number of lighting occurrences is the same across the plural lighting patterns, and such that lighting timing is different between the plural lighting patterns.

13. The computer-readable medium as claimed in claim 9, wherein the control step performs phase control and wave-number-based control successively one after another, both the phase control and the wave-number-based control using the one or more lighting patterns responsive to the determined proportion of lighting time.

14. The computer-readable medium as claimed in claim 9, wherein a lighting pattern table is provided that stores lighting patterns, associated with respective proportions of lighting time, separately for each proportion of at least 10%, 20%, 30%, 40%, and 50%, and the control step includes the steps of:

retrieving from the lighting pattern table, in a case of the determined proportion of lighting time being larger than 50%, the one or more lighting patterns associated with a percentage obtained by subtracting the determined proportion of lighting time from 100%; and controlling the supply of alternating current power to the heater both by stopping the supply of alternating current power to the heater at lighting timing indicated by the retrieved one or more lighting patterns and by supplying alternating current power to the heater at non-lighting timing indicated by the retrieved one or more lighting patterns.

15. The computer-readable recording medium as claimed in claim 14, wherein said at least one heater includes a plurality of heaters, and wherein the determining step determines a proportion of lighting time for lighting a heater for each one of the heaters based on the detected temperature and the preset target temperature of the heating object, and the control step retrieves from the lighting pattern table, in a case of a sum of the determined proportions of lighting time for the heaters exceeding 100%, the one or more lighting patterns associated with last two digits of the sum, and supplies alternating current power to all the heaters at lighting timing indicated by the retrieved one or more lighting patterns.

* * * * *